US010374295B2

(12) United States Patent
Kim et al.

(10) Patent No.: US 10,374,295 B2
(45) Date of Patent: Aug. 6, 2019

(54) ELECTRONIC DEVICE INCLUDING DISPLAY

(71) Applicant: Samsung Electronics Co., Ltd., Suwon-si, Gyeonggi-do (KR)

(72) Inventors: Yoon-Geon Kim, Seoul (KR); Seung-Tae Ko, Bucheon-si (KR); Sang-Ho Lim, Suwon-si (KR); Dong-Kyu Choi, Suwon-si (KR); Won-Bin Hong, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 123 days.

(21) Appl. No.: 15/491,400

(22) Filed: Apr. 19, 2017

(65) Prior Publication Data

US 2017/0309995 A1 Oct. 26, 2017

(30) Foreign Application Priority Data

Apr. 20, 2016 (KR) ..... 10-2016-0048018

(51) Int. Cl.

| | |
|---|---|
| ***H01Q 1/27*** | (2006.01) |
| ***H01Q 1/24*** | (2006.01) |
| ***H01Q 1/44*** | (2006.01) |
| ***H01Q 9/04*** | (2006.01) |

(52) U.S. Cl.

CPC ..... *H01Q 1/273* (2013.01); *H01Q 1/243* (2013.01); *H01Q 1/44* (2013.01); *H01Q 9/0457* (2013.01)

(58) Field of Classification Search

CPC ..... H01Q 1/273; H01Q 5/10; H01Q 9/0421; H01Q 1/48; H01Q 1/22; H01Q 9/0407; H01Q 9/0457; H01Q 1/243; H01Q 1/44

USPC ..... 343/702, 700 MS

See application file for complete search history.

(56) References Cited

U.S. PATENT DOCUMENTS

| | | | | |
|---|---|---|---|---|
| 5,065,453 | A | 11/1991 | Thomas | |
| 6,973,709 | B2 * | 12/2005 | Huang | H01Q 1/243 29/600 |
| 8,922,434 | B2 * | 12/2014 | Prat | H01Q 1/2266 343/700 MS |
| 2013/0328582 | A1 | 12/2013 | Han et al. | |
| 2014/0104157 | A1 | 4/2014 | Burns et al. | |
| 2014/0334322 | A1 | 11/2014 | Shtrom et al. | |
| 2015/0144934 | A1 | 5/2015 | Rappoport et al. | |
| 2015/0255853 | A1 | 9/2015 | Kwong et al. | |

(Continued)

FOREIGN PATENT DOCUMENTS

| | | | |
|---|---|---|---|
| JP | 2014-057243 | A | 3/2014 |
| KR | 10-2006-0085879 | A | 7/2006 |
| KR | 10-2009-0051633 | A | 5/2009 |

OTHER PUBLICATIONS

European Search Report dated Mar. 29, 2019, issued in European Patent Application No. 17786175.4.

*Primary Examiner* — Khai M Nguyen

(74) *Attorney, Agent, or Firm* — Jefferson IP Law, LLP

(57) ABSTRACT

An electronic device that utilizes a display as an antenna is provided. The electronic device may include a display including a conductive layer, a signal power supply part electrically coupled to the conductive layer in order to utilize the conductive layer as an antenna radiator, and a substrate electrically connected to the signal power supply part so as to receive a signal of an antenna radiator of the conductive layer through the signal power supply part.

29 Claims, 26 Drawing Sheets

(56) References Cited

U.S. PATENT DOCUMENTS

| | | | |
|---|---|---|---|
| 2015/0311960 | A1 | 10/2015 | Samardzija et al. |
| 2015/0380825 | A1 | 12/2015 | Ryu et al. |

* cited by examiner

ELECTRONIC DEVICE INCLUDING DISPLAY

CROSS-REFERENCE TO RELATED APPLICATION(S)

This application claims the benefit under 35 U.S.C. § 119(a) of a Korean patent application filed on Apr. 20, 2016 in the Korean Intellectual Property Office and assigned Ser. No. 10-2016-0048018, the entire disclosure of which is hereby incorporated by reference.

TECHNICAL FIELD

The present disclosure relates to an electronic device. More particularly, the present disclosure relates to an electronic device that implements a wireless communication function by utilizing a conductive layer of a display as an antenna radiator.

BACKGROUND

Recently, a variety of electronic devices, such as mobile phones, Moving Picture Experts Group (MPEG-1 or MPEG-2) audio layer 3 (MP3) players, portable multimedia players (PMPs), tablet personal computers (PCs), Galaxy tabs, iPads, or e-book readers, have been provided to users, and the users can access a variety of content while carrying the various electronic devices.

As such, with the rapid development of information communication technology, the electronic device adopts various functions, such as reproducing music and videos, playing games, a camera function, schedule management, or dictionaries, as well as original functions, in order to meet the various needs of the user. Furthermore, the electronic device provides a function of searching for a variety of information and a function of adding new applications.

The electronic devices have been led by mobile communication terminals, and in recent years, wearable electronic devices that are worn on the human body have been developed in order to thereby satisfy the desire of customers by adopting a lightened and miniaturized structure and by providing various functions.

The mobile communication terminal requires an antenna device in order to enable wireless communication. The antenna device is installed to be spaced apart by a sufficient distance from other circuit devices in order to suppress interference with other circuit devices in the process of transmitting and receiving high frequency signals. The antenna device is mainly embedded in the mobile communication terminal.

This antenna device is required to have an excellent radiation performance and a wide bandwidth even with a small volume in order to meet a design trend toward the slimness and miniaturization of the mobile communication terminal. In particular, with regard to the embedded type of antenna device, since there is a trend in which the area for mounting the antenna gradually narrows in the mobile communication terminal, the key feature of the antenna design is that excellent radiation performance should be secured without changing the size of the entire antenna device.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide a separate antenna device to the mobile communication terminal, an antenna mounting space should be secured in the mobile communication terminal, which increases the size of the mobile communication terminal and an inactive area, and thus, this runs counter to the slimness and miniaturization of the terminal.

Therefore, various aspects of the present disclosure provide an electronic device that can utilize, as an antenna radiator, a conductive layer of a display that is provided in the electronic device.

In accordance with an aspect of the present disclosure, an electronic device is provided. The electronic device includes a display including a conductive layer, and a signal power supply part electrically connected to the conductive layer so as to utilize the conductive layer as an antenna radiator.

In accordance with another aspect of the present disclosure, an electronic device is provided. The electronic device includes a window, a touch panel, a display including a conductive layer, a signal power supply part electrically coupled to the conductive layer so as to utilize the conductive layer as an antenna radiator, a substrate electrically connected to the signal power supply part so as to transmit and receive a signal of an antenna radiator of the conductive layer through the signal power supply part, and a rear case supporting the substrate.

In accordance with another aspect of the present disclosure, an electronic device is provided. The electronic device includes a window, a touch panel, a display including a conductive layer, a signal power supply part electrically coupled to the conductive layer for the utilization of the conductive layer as an antenna radiator and for frequency tuning of the antenna radiator, a shorting part provided near the signal power supply part for the frequency tuning of the antenna radiator, a substrate electrically connected to the signal power supply part and the shorting part so as to transmit and receive a signal of the antenna radiator of the conductive layer and a tuned signal of the shorting part through the signal power supply part and the shorting part, a rear case supporting the substrate, and a ground provided under the substrate so as to be electrically connected to the substrate.

In accordance with another aspect of the present invention, an electronic device is provided. The electronic device includes a window, a touch panel, a display including a conductive layer, a signal power supply part electrically coupled to the conductive layer for the utilization of the conductive layer as an antenna radiator and for the frequency tuning of the antenna radiator, an active element provided near the signal power supply part for the frequency tuning of the antenna radiator, a substrate electrically connected to the signal power supply part and the active element so as to transmit and receive a signal of the antenna radiator of the conductive layer and a frequency tuning signal of the active element through the signal power supply part and the active element, a rear case supporting the substrate, and a ground provided under the substrate so as to be electrically connected to the substrate to induce an additional resonance.

In accordance with another aspect of the present disclosure, an electronic device is provided. The electronic device includes a window, a touch panel, a display including a conductive layer, a first pad electrically coupled to the conductive layer in order to utilize the conductive layer as an antenna radiator, and induces a one-wavelength resonance to form a beam pattern of an antenna, a second pad electrically coupled to the conductive layer in order to utilize the conductive layer as an antenna radiator, and induces a half-wavelength resonance to form a beam pattern of an antenna, a sensor configured to detect motions of the electronic device, at least one processor configured to: determine a usage scenario of the electronic device by using the sensor unit, and control a switch to select the first pad or the second pad, a switch configured to switch between the first pad and the second pad by means of the controller, a signal power supply part configured to receive a switched signal of the switch, a substrate electrically connected to the signal power supply part, and configured to transmit and receive an antenna signal of the first pad or the second pad selected by the switch, and a rear case supporting the substrate.

In accordance with another aspect of the present disclosure, it is possible to improve the antenna radiation performance of the electronic device by utilizing the conductive layer included in the display of the electronic device as an antenna radiator, and it is possible to prevent the deterioration of the display visibility because a separate antenna is not required to be provided in the electronic device. Furthermore, since the electronic device does not require a separate mounting space and active area for the antenna therein, the slimness and miniaturization of the electronic device can be achieved.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, like reference numerals will be understood to refer to like parts, components, and structures.

DETAILED DESCRIPTION

Figure 1:
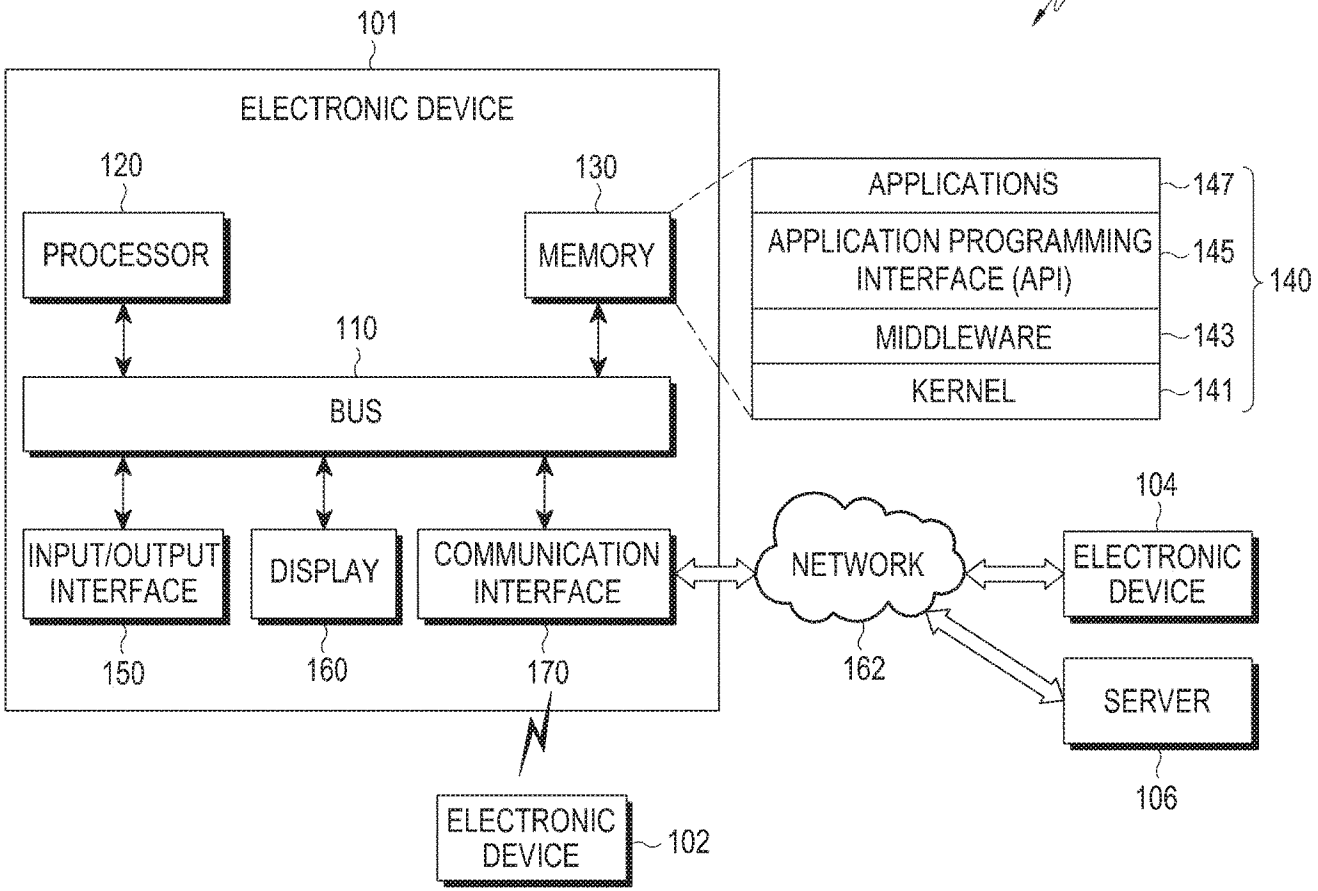
FIG. 1 is a block diagram illustrating a network environment including an electronic device according to an embodiment of the present disclosure.

The following description with reference to the accompanying drawings is provided to assist in a comprehensive understanding of various embodiments of the present disclosure as defined by the claims and their equivalents. It includes various specific details to assist in that understanding, but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but are merely used by the inventor to enable a clear and consistent understanding of the present disclosure. Accordingly, it should be apparent to those skilled in the art that the following description of various embodiments of the present disclosure is provided for illustration purposes only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Although terms including an ordinal number such as first, second, etc. can be used for describing various elements, the structural elements are not restricted by the terms. The terms are used merely for the purpose to distinguish an element from the other elements. For example, a first element could be termed a second element, and similarly, a second element could be also termed a first element without departing from the scope of the present disclosure.

An electronic device to be connected to an audio device, according to the various embodiments of the present disclosure, is described below. Application examples of the electronic device, according to an embodiment of the present disclosure, may include not only all mobile communication terminals operating based on communication protocols corresponding to various communication systems but also all information communication devices, multimedia devices, and application devices thereof, such as a video telephone, an e-book reader, a laptop personal computer (PC), a netbook computer, a personal digital assistant (PDA), a portable multimedia player (PMP), a Moving Picture Experts Group (MPEG-1 or MPEG-2) audio layer-3 (MP3) player, a mobile medical device, a camera, a wearable device (e.g., a head mounted device (HMD) such as electronic glasses, electronic clothing, an electronic bracelet, an electronic necklace, an electronic appcessory, an electronic tattoo, or a smart watch), and the like.

The electronic device may be a smart home appliance. For example, the smart home appliance may include at least one of a television, a digital versatile disc (DVD) player, an audio, a refrigerator, an air conditioner, a vacuum cleaner, an oven, a microwave oven, a washing machine, an air cleaner, a set-top box, a television (TV) box (e.g., Samsung HomeSync™, Apple TV™, or Google TV™), a game console, an electronic dictionary, an electronic key, a camcorder, and an electronic photo frame.

The electronic devices may include at least one of various medical devices (e.g., a magnetic resonance angiography (MRA), a magnetic resonance imaging (MRI), a computed tomography (CT) machine, and an ultrasonic machine), navigation devices, global positioning system (GPS) receivers, event data recorders (EDR), flight data recorders (FDR), vehicle infotainment devices, electronic devices for ships (e.g., navigation devices for ships, and gyro-compasses), avionics, security devices, automotive head units, robots for home or industry, automatic teller's machines (ATMs) in banks, or point of sales (POS) in shops.

The electronic device may include at least one of furniture or a part of a building/structure, an electronic board, an electronic signature receiving device, a projector, and various types of measuring devices (e.g., a water meter, an electric meter, a gas meter, a radio wave meter, and the like) including a camera function.

An electronic device according to various embodiments of the present disclosure may be a combination of one or more of above described various devices. An electronic device according to various embodiments of the present disclosure may be a flexible device. An electronic device according to various embodiments of the present disclosure is not limited to the above described devices.

FIG. 1 illustrates a network environment including an electronic device according to an embodiment of the present disclosure.

Referring to FIG. 1, the network environment 100 including the electronic device 101 may include a bus 110, a processor 120, a memory 130, an input/output interface 150, a display 160, and a communication interface 170. The bus 110 may be a circuit for connecting the components of the electronic device 101 to each other and for transferring communication data (for example, control messages) between the elements.

The processor 120 may receive instructions from other components (e.g., the memory 130, the input/output interface 150, the display 160, the communication interface 170, or the like) through, for example, the bus 110, and may decode the received instructions and perform a calculation or data processing according to the decoded instructions.

The memory 130 may store instructions or data that is received from the processor 120 or other components (e.g., the input/output interface 150, the display 160, the communication interface 170, or the like), or that is created by the processor 120 or by other components. The memory 130 may include programming modules 140, such as a kernel 141, middleware 143, an application programming interface (API) 145, applications 147, or the like. Each of the programming modules 140 may be configured by software, firmware, hardware, or a combination thereof.

The kernel 141 may control or manage system resources (e.g., the bus 110, the processor 120, the memory 130, or the like) that are used to execute the operation or function that is implemented in the other remaining programming modules (e.g., the middleware 143, the API 145, or the applications 147). In addition, the kernel 141 may provide an interface by which the middleware 143, the API 145, or the applications 147 may access each component of the electronic device 101 for control or management.

The middleware 143 may play the intermediate role between the API 145 or the applications 147 and the kernel 141 to communicate with each other for the transmission and reception of data. Furthermore, in relation to one or more operation requests that are received from the applications 147, the middleware 143 control (e.g., scheduling or load balancing) the operation requests by using, for example, a method of giving priority for using the system resources (e.g., the bus 110, the processor 120, the memory 130, or the like) of the electronic device 101 to one or more of the applications 134.

The API 145 may be an interface by which the applications 147 control functions that are provided by the kernel 141 or the middleware 143, and, for example, may include one or more interfaces or functions (for example, instructions) for file control, window control, image processing, or text control.

According to various embodiments of the present disclosure, the applications 147 may include a short message service (SMS)/multimedia message service (MMS) application, an e-mail application, a calendar application, an alarm application, a healthcare application (for example, an application for measuring the amount of exercise or blood glucose), an environment information application (for example, an application for providing atmospheric pressure, humidity, or temperature information), or the like. Additionally or alternatively, the applications 147 may include an application that is related to the exchange of information between an electronic device 102 and an external electronic device (e.g., an electronic device 104). The application related to the information-exchange, for example, may include a notification relay application for relaying specific information to the external electronic device, or may include a device management application for managing the external electronic device.

For example, the notification relay application may include a function of transferring notification information that is generated in other applications (e.g., the SMS/MMS application, the e-mail application, the healthcare application, the environment information application, or the like) of the electronic device 101 to the external electronic device 102 or 104. Additionally or alternatively, the notification relay application may receive notification information from the external electronic device (e.g., the electronic device 104) to then provide the notification information to the user. The device management application, for example, may manage (e.g., install, delete, or update) one or more functions (e.g., enabling/disabling the external electronic device itself (or some components) or adjusting the brightness (or resolution) of a display) of the external electronic device (e.g., the electronic device 104) that communicates with the electronic device 101; applications that are executed in the external electronic device; or services (e.g., a phone call service or a messaging service) that are provided by the external electronic device.

The applications 147 may include applications that are designated according to the attribute (e.g., the type of electronic device) of the external electronic device (e.g., the electronic device 104). For example, in the case where the external electronic device is an MP3 player, the applications 147 may include an application that is related to the reproduction of music. Likewise, in the case where the external electronic device is a mobile medical device, the applications 147 may include an application that is related to health management. The applications 147 may include at least one application that is designated in the electronic device 101 or applications that are received from the external electronic device (e.g., the server 106 or the electronic device 104).

The input/output interface 150 may transfer instructions or data input by a user through input/output devices (e.g., sensors, keyboards, or touch screens) to the processor 120, the memory 130, or the communication interface 170 through, for example, the bus 110. The input/output interface 150 may provide data on a user's touch input through a touch screen to the processor 120. The input/output interface 150 may output, through input/output devices (e.g., speakers or displays), instructions or data that are received from the processor 120, the memory 130, or the communication interface 170 through the bus 110. The input/output interface 150 may include an audio module.

The display 160 may display a variety of information (e.g., multimedia data, text data, or the like) to the user.

The communication interface 170 may perform communication between the electronic device 101 and external electronic devices (e.g., the electronic device 104 or the server 106). For example, the communication interface 170 may be connected to a network 162 through wireless communication or wired communication to thereby communicate with the external electronic devices. The wireless communication may include at least one of Wi-Fi, Bluetooth (BT), near field communication (NFC), a global positioning system (GPS), or cellular communications (e.g., long-term evolution (LTE), LTE-advanced (LTE-A), code division multiple access (CDMA), wideband-CDMA (WCDMA), universal mobile telecommunication system (UMTS), wireless broadband (WiBro), or global system for mobile communication (GSM)). The wired communication may include at least one of a universal serial bus (USB), a high definition multimedia interface (HDMI), recommended standard 232 (RS-232), or a plain old telephone service (POTS).

The network 162 may be a telecommunication network. The telecommunication networks may include at least one of a computer network, the Internet, the Internet of things (IoT), or a telephone network. Protocols (e.g., a transport layer protocol, a data link layer protocol, or a physical layer protocol) for communication between the electronic device 101 and the external electronic device 104 may be supported by at least one of the applications 147, the API 145, the middleware 143, the kernel 141, or the communication interface 170.

A controller may include the processor 120 and a memory 130 for storing information that is required by the processor 120. The controller, which is a central processing unit, may control the overall operations of the electronic device 101, and may perform an operation of supplying electric power to an antenna for wireless communication as described later, according to the embodiment of the present disclosure.

Furthermore, the electronic device according to the 4 or 5th generation mobile communication standard, such as the LTE communication standard mentioned above, accesses commercial communication networks through a variety of frequency bands. A single electronic device may have a plurality of antennas corresponding to the number of frequency bands in order to make a connection through various frequency bands.

As described above, the wireless communication of the antenna may include cellular communication, Wi-Fi, BT, GPS, NFC, and radio frequency (RF).

The antenna may provide voice calls, video calls, a messaging service, or the Internet service through the communication network. Each of the Wi-Fi, BT, GPS, and NFC may be configured with a module, and each module may include a processor for processing data that is transmitted and received through the corresponding terminal. At least some (two or more) of the cellular module, the Wi-Fi module, the BT module, the GPS module, or the NFC module may be included in a single integrated chip (IC) or IC package.

The RF module, for example, may transmit and receive communication signals (for example, RF signals). For example, the RF module may include a transceiver, a power amp module (PAM), a frequency filter, a low noise amplifier (LNA), an antenna, or the like. At least one of the cellular module, the Wi-Fi module, the BT module, the GPS module, or the NFC module may transmit and receive RF signals through a separate RF module.

The electronic device 101 that includes the antenna may be configured by one of a wearable device, a laptop, a netbook, a smart phone, a tablet PC, Galaxy™ tab, iPad™, or a wireless charging device as described above. The electronic device may be configured to include a wearable device that may be worn on the user's body, such as on a wrist. The wearable device may be worn on other body parts other than the wrist. The wearable device may include a window, a touch panel, a display including a conductive layer, a signal power supply part, a substrate, and a rear case.

The rear case may be provided with a fastening member that is wound around the wrist to be worn on the same while the rear case is placed thereon. The fastening member may be made of at least one material of a metal, leather, rubber, silicon, or urethane, and the fastening member may be made of other materials other than the materials mentioned above.

The electronic device, according to various embodiments of the present disclosure, may be configured to utilize a conductive layer provided in a display as an antenna radiator in order to thereby improve the visibility of the display and in order to thereby prevent the deterioration of a touch function and radiation performance of the antenna. In the following description, the radiation performance of the antenna means the transmission/reception ability of the antenna. The radiation performance may refer to the ability of receiving signals that are transmitted from other terminals to have a minimum loss and the ability of transmitting signals to be transmitted through the air to have a minimum loss.

In addition, although the various embodiments of the present disclosure describe that the antenna is provided in the wearable device and the conductive layer of the display is utilized as an antenna, the present disclosure is not limited thereto. For example, the present disclosure may be applied to various electronic devices for communication that include a metal member that may be used as an antenna radiator rather than the conductive layer of the display. Various metal members may be adopted as long as they can transmit and receive wireless signals. An electronic device, according to various embodiments of the present disclosure, is described in detail with reference to the drawings below.

Figure 2A:
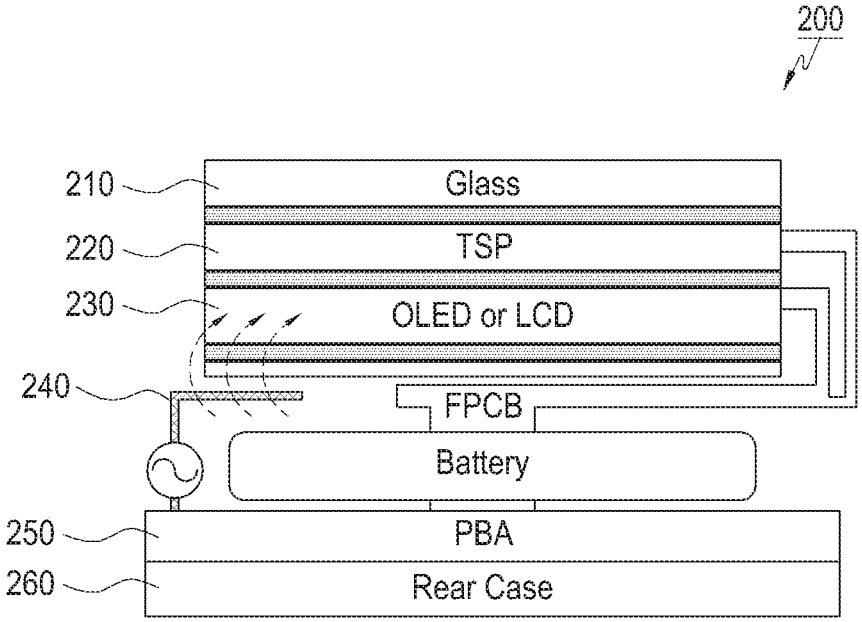
FIG. 2A is a cross-sectional side view illustrating the configuration of an electronic device according to an embodiment of the present disclosure.
Figure 2B:
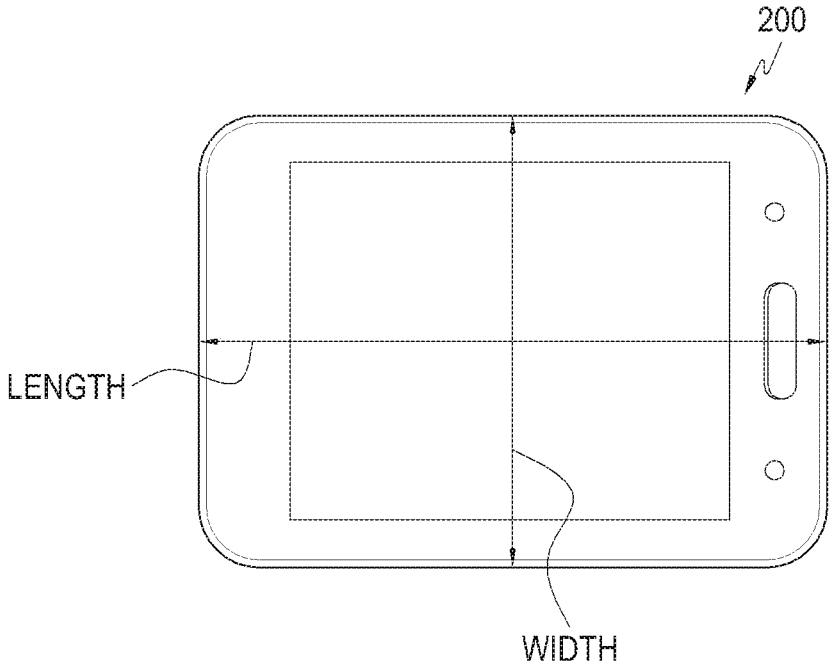
FIG. 2B is a plan view illustrating the configuration of an electronic device according to an embodiment of the present disclosure.

FIG. 2A is a cross-sectional side view illustrating the configuration of an electronic device according to an embodiment of the present disclosure, and FIG. 2B is a plan view illustrating the configuration of an electronic device according to an embodiment of the present disclosure.

Figure 2C:
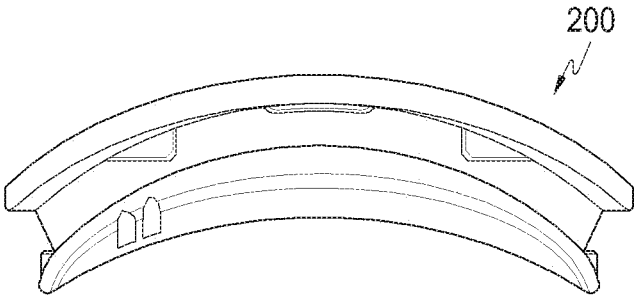
FIG. 2C is a side view illustrating the configuration of an electronic device according to an embodiment of the present disclosure.
Figure 3:
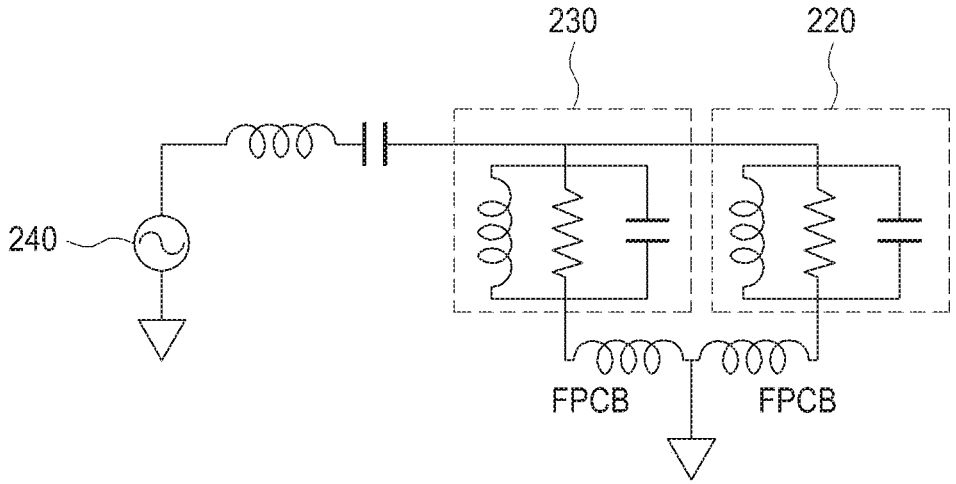
FIG. 3 is an equivalent circuit diagram illustrating the configuration of an electronic device according to an embodiment of the present disclosure.

FIG. 2C is a side view illustrating the configuration of an electronic device according to an embodiment of the present disclosure, and FIG. 3 is an equivalent circuit diagram illustrating the configuration of an electronic device according to an embodiment of the present disclosure.

Referring to FIGS. 2A, 2B, 2C, and 3, the electronic device 200 may include a window 210, a touch panel 220, a display 230 including a conductive layer 230*a*, a signal power supply part 240, a substrate 250, and a rear case 260.

The window 210 may be provided on the touch panel 220 so as to protect the touch panel 220. The touch panel 220 may be provided under the window 210 in order to make a touch input. The display 230 may include the conductive layer 230*a* to be utilized as an antenna radiator, and may be provided under the touch panel 220. The signal power supply part 240 may be provided under the display 230 so as to be electrically coupled to the conductive layer 230*a* in order to utilize the conductive layer 230*a* as an antenna radiator. The substrate 250 may be provided under the display 230 to be electrically connected to the signal power supply part 240 and to transmit and receive a signal of the antenna radiator of the conductive layer 230*a* through the signal power supply part 240. The signal power supply part 240 may be disposed between the display 230 and the substrate 250. The rear case 260 may support the substrate 250, and may be provided with a fastening member (not shown) to be worn on the user's wrist.

As described above, the conductive layer 230*a* of the display 230 may be utilized as an antenna radiator to then be used for an antenna function of the electronic device 200 in order to prevent the degradation of the visibility of the display 230 because a typical antenna does not need to be separately provided in the electronic device 200, and in order to attain the miniaturization and slimness of the electronic device because a separate mounting space and an active area for a typical antenna are not required.

For example, the display 230 may utilize a resonance phenomenon of $N\times\lambda/4$ to $N\times\lambda/2$ (N=1, 2, 3, . . . : natural number) of at least one of the width or length of the conductive layer 230*a*. For example, the display may utilize the wavelength of the antenna in the width direction of the antenna, or may utilize the wavelength of the antenna in the length direction of the conductive layer. As another example, the wavelength of the antenna may be utilized according to the width and length of the conductive layer.

The display 230 may be configured to include one of either a liquid crystal display (LCD) or an organic light emitting diode (OLED) 231. The display 230 may also be applied to other displays (e.g., an LED or an active matrix OLED (AMOLED)), as well as the aforementioned displays.

The conductive layers 230*a* and 231*a* provided in the LCD 230 and the OLED 231 will be described in more detail below.

Figure 4:
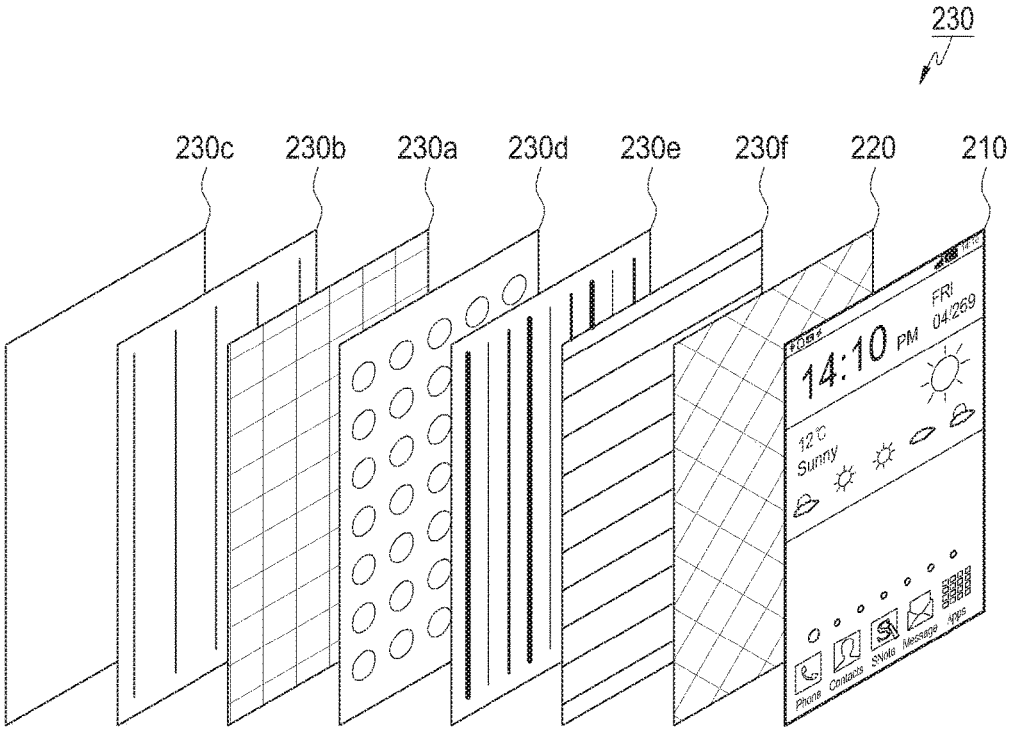
FIG. 4 is a perspective view illustrating the configuration of a liquid crystal display (LCD) that is provided in an electronic device according to an embodiment of the present disclosure.
Figure 5:
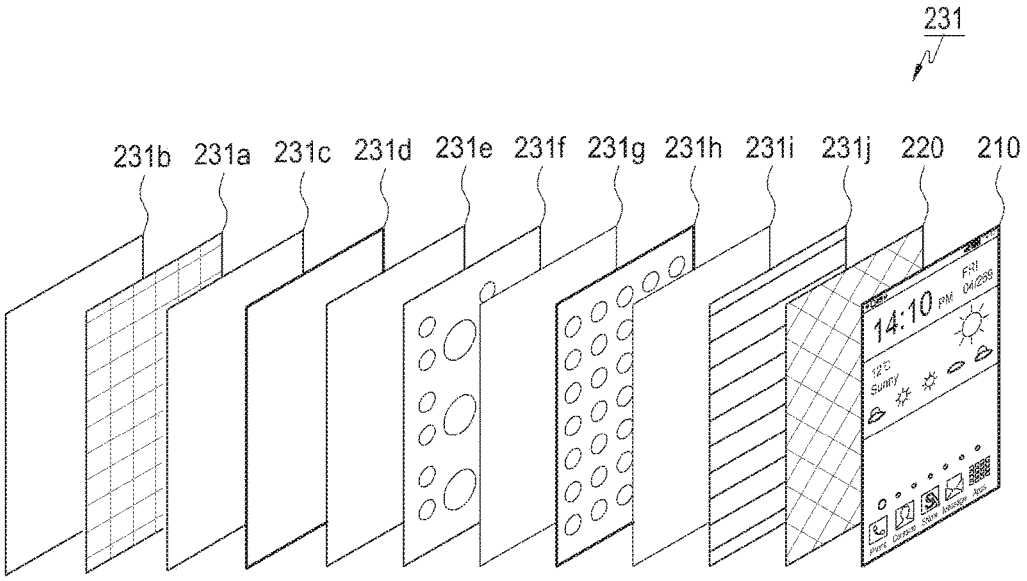
FIG. 5 is a perspective view illustrating the configuration of an organic light emitting diode (OLED) that is provided in an electronic device according to an embodiment of the present disclosure.
Figure 6:
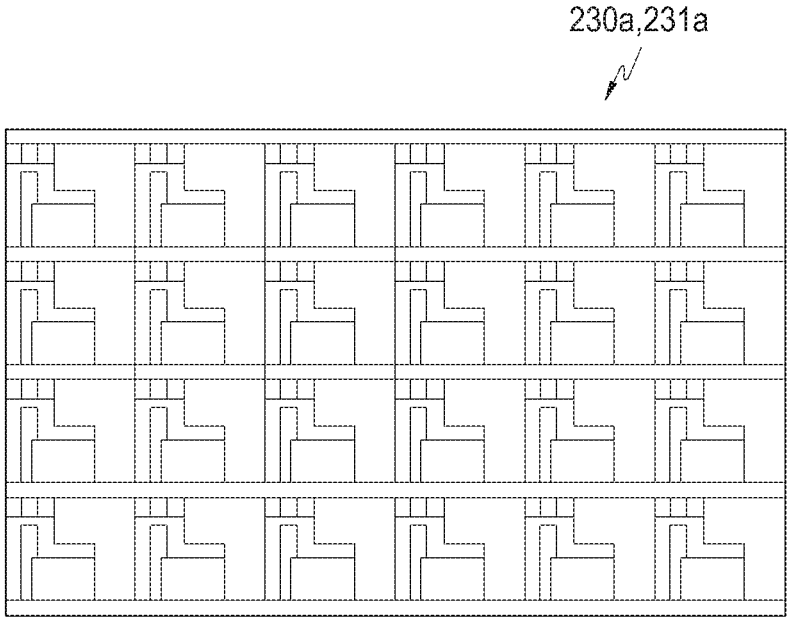
FIG. 6 is a view illustrating the structure of a thin film transistor (TFT) layer that is a conductive layer in the configurations of an LCD and an OLED that are provided in an electronic device according to an embodiment of the present disclosure.

FIG. 4 is a perspective view illustrating the configuration of an LCD that is provided in an electronic device according to various embodiments of the present disclosure, and FIG. 5 is a perspective view illustrating the configuration of an OLED that is provided in the electronic device according to an embodiment of the present disclosure. FIG. 6 is a view illustrating the structure of a thin film transistor (TFT) array layer that is a conductive layer in the configurations of the LCD and the organic light emitting diode (OLED) that are provided in the electronic device 200 according to an embodiment of the present disclosure.

Referring to FIG. 4, the LCD 230 may include the window 210, the touch panel 220, a polarizing film layer (POL) 230*f*, a color filter layer 230*e*, a pixel layer (cell) 230*d*, a TFT layer 230*a*, a POL 230*b*, and a backlight unit (BLU) 230*c*.

The conductive layer 230*a* of the display 230 may be configured to include a TFT array layer. Although the TFT array layer is described as an example of the conductive layer 230*a*, the conductive layer 230*a* is not limited thereto. The conductive layer 230*a* may be applied to a variety of layers, as well as the TFT array layer, as long as they are formed of a conductive material. For example, the conductive layer 230*a* may include the touch panel 220, the pixel layer 230*d*, the back light unit 230*c*, or the like.

Referring to FIG. 5, the OLED 231 may include the window 210, the touch panel 220, a POL 231*j*, a cathode layer 231*i*, an electron injection layer (EIL) 231*h*, an electron transport layer (ETL) 231*g*, a light emitting layer (EML) 231*f*, a hole transport layer (HTL) 231*e*, a hole injection layer (HIL) 231*d*, an anode layer 231*c*, the TFT array layer 231*a*, and a black embo 231*b*.

The conductive layer 231*a* of the OLED 231 may be configured to include a TFT array layer. Although the TFT array layer is described as an example of the conductive layer 231*a*, the conductive layer 231*a* is not limited thereto. The conductive layer 231*a* may be applied to a variety of layers, as well as the TFT array layer, as long as they are formed of a conductive material. For example, the conductive layer may include the touch panel 220, the cathode layer, the anode layer, or the like.

The TFT array layers 230*a* and 231*a* provided in the LCD 230 and the OLED 231 may include a conductive line for providing a TFT element with electric power, data, a ground (GND) bias, or the like. Therefore, since the TFT array layer 230*a* or 231*a* has the highest conductivity according to the internal structure configuration of the display, the TFT array layer can be utilized as an antenna radiator.

According to various embodiments of the present disclosure, the electronic device may include a display that includes a conductive layer; and a signal power supply part that is electrically connected to the conductive layer in order to utilize the conductive layer as an antenna radiator.

According to various embodiments of the present disclosure, the electronic device may include a window; a touch panel; a display that includes a conductive layer; a signal power supply part that is electrically coupled to the conductive layer in order to utilize the conductive layer as an antenna radiator; a substrate that is electrically connected to the signal power supply part so as to transmit and receive a signal of an antenna radiator of the conductive layer through the signal power supply part; and a rear case that supports the substrate.

According to various embodiments of the present disclosure, the display may be configured to include one of either an LCD or an OLED.

According to various embodiments of the present disclosure, the conductive layer may be configured to include a TFT array layer.

According to various embodiments of the present disclosure, the signal power supply part may be wirelessly and electrically coupled to the conductive layer.

The signal power supply part 240 may be wirelessly and electrically coupled to the conductive layer 230*a* or 231*a* in order to utilize the same as an antenna radiator.

Figure 7A:
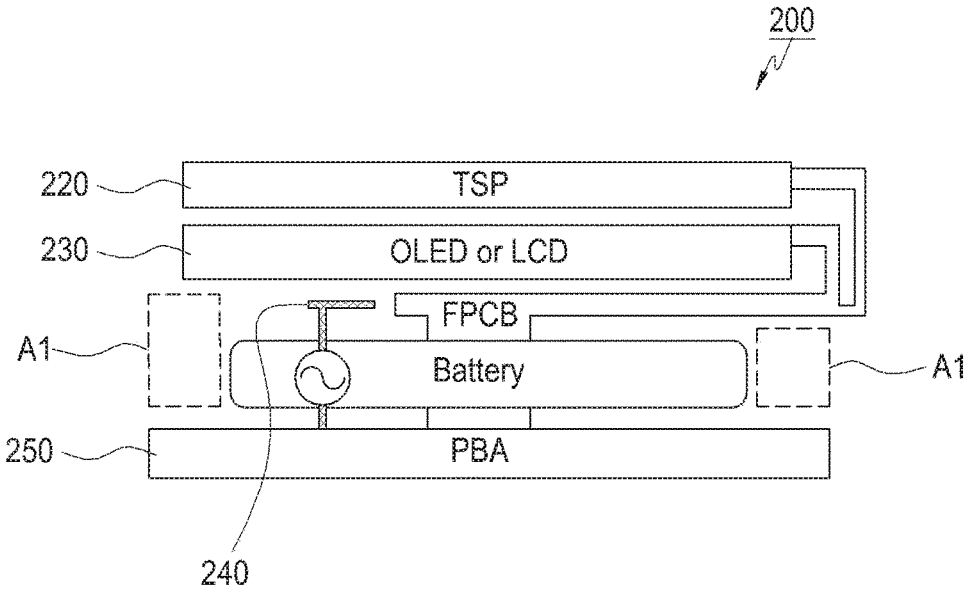
FIG. 7A is a cross-sectional side view illustrating the configuration of an electronic device according to an embodiment of the present disclosure.
Figure 7B:
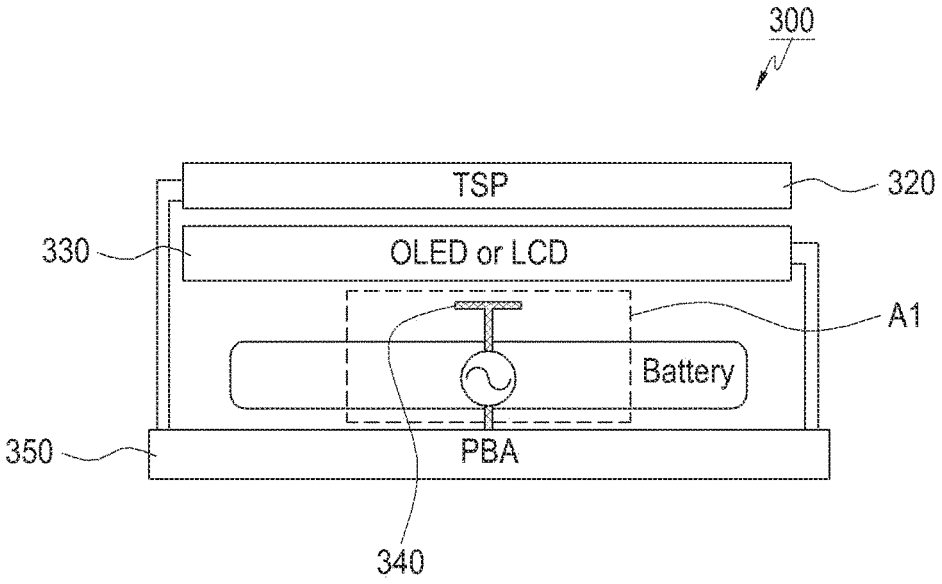
FIG. 7B is a cross-sectional side view illustrating the configuration of an electronic device according to an embodiment of the present disclosure.
Figure 7C:
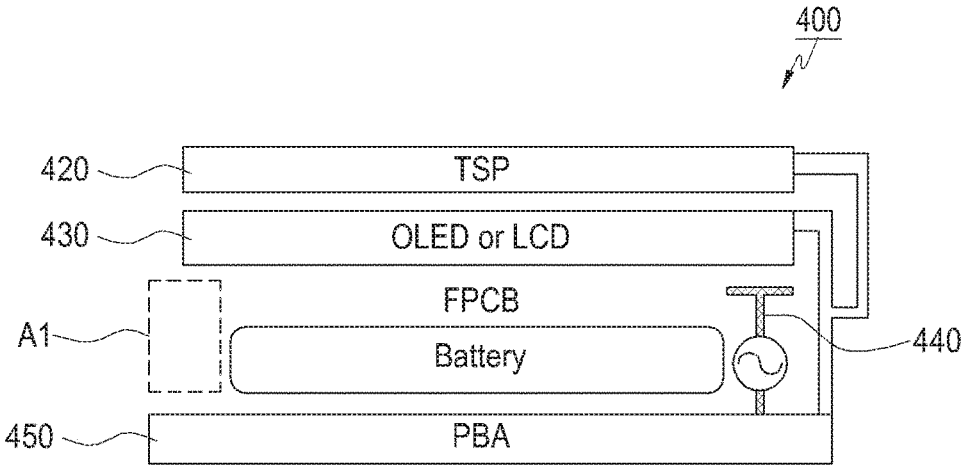
FIG. 7C is a cross-sectional side view illustrating the configuration of an electronic device according to an embodiment of the present disclosure.

FIG. 7A is a cross-sectional side view illustrating the configuration of an electronic device according to an embodiment of the present disclosure, and FIG. 7B is a cross-sectional side view illustrating the configuration of an electronic device according to an embodiment of the present disclosure. FIG. 7C is a cross-sectional side view illustrating the configuration of an electronic device according to an embodiment of the present disclosure.

Referring to FIG. 7A, the signal power supply part 240 may be disposed in the first area out of the central area of the display 230. For example, the signal power supply part 240 may be disposed on the left side of a flexible printed circuit board (FPCB) that electrically connects the touch panel 220 and the display 230 with the substrate 250, and an electric field (A1) may be generated in the left and right area of the FPCB, respectively. The electronic device having such a structure may utilize a resonant frequency of a half-wavelength or a resonant frequency of one wavelength in the length direction of the display 230.

Referring to FIG. 7B, a signal power supply part 340 may be disposed in the central area of a display 330 of an electronic device 300. For example, an FPCB that is electrically connected to a substrate 350 may be disposed on the first side (for example, the left side) of the touch panel 320, and an FPCB that is electrically connected to the substrate 350 may be disposed on the second side (for example, the right side) of the touch panel 320, which is opposite to the first side. In this state, the signal power supply part 340 may be disposed in the central area of the display 330, and may generate an electric field (A1). The electronic device 300 having such a structure may utilize a resonant frequency of a half-wavelength or a resonant frequency of one wavelength in the width direction of the display 330.

Referring to FIG. 7C, the signal power supply part 440 may be disposed in the second area (e.g., the right area) out of the central area of the display 430, which is opposite to the first area (e.g., the left area). For example, an FPCB that is electrically connected to the substrate 450 may be disposed on the first side (e.g., the right side) of the touch panel 420 or the display 430, and an electric field (A1) may be formed on the second side (for example, the left side) that is opposite to the first side. The electronic device 400 having such a structure may utilize a resonant frequency of $\lambda/4$, $3\lambda/4$, or $5\lambda/4$ that is generated.

According to various embodiments of the present disclosure, the signal power supply part may be disposed in the first area out of the central area of the display, in the second area on the opposite side of the first area, or in the central area of the display.

Figure 8:
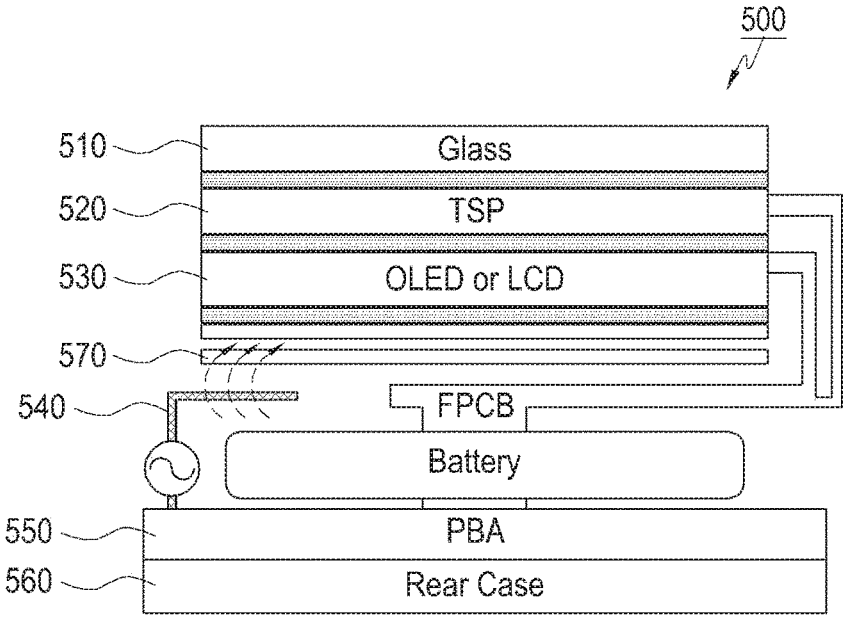
FIG. 8 is a cross-sectional side view illustrating the configuration of an electronic device according to an embodiment of the present disclosure.

FIG. 8 is a cross-sectional side view illustrating another configuration of an electronic device according to an embodiment of the present disclosure.

Referring to FIG. 8, the electronic device 500 may include a window 510, a touch panel 520, a display 530, a signal power supply part 540, a patch antenna 570, a substrate 550, and a rear case 560. The window 510, the touch panel 520, the display 530, and the rear case 560 have the same configuration as that of the embodiment shown in FIG. 2A above, so the detailed description thereof will be omitted. According to an embodiment of the present disclosure, the patch antenna 570 may be provided between the display 530 and the signal power supply part 540. The signal power supply part 540 may be electrically coupled to the patch antenna 570 in order to use the same as an antenna of the electronic device 500. The substrate 550 may be electrically connected to the signal power supply part 540, and may transmit and receive a signal of an antenna radiator of the patch antenna 570 through the signal power supply part 540.

The patch antenna 570 may be separately provided between the display 530 and the signal power supply part 540 to then be used as an antenna of the electronic device 500.

According to an embodiments of the present disclosure, a patch antenna may be provided between the display and the signal power supply part.

Figure 9:
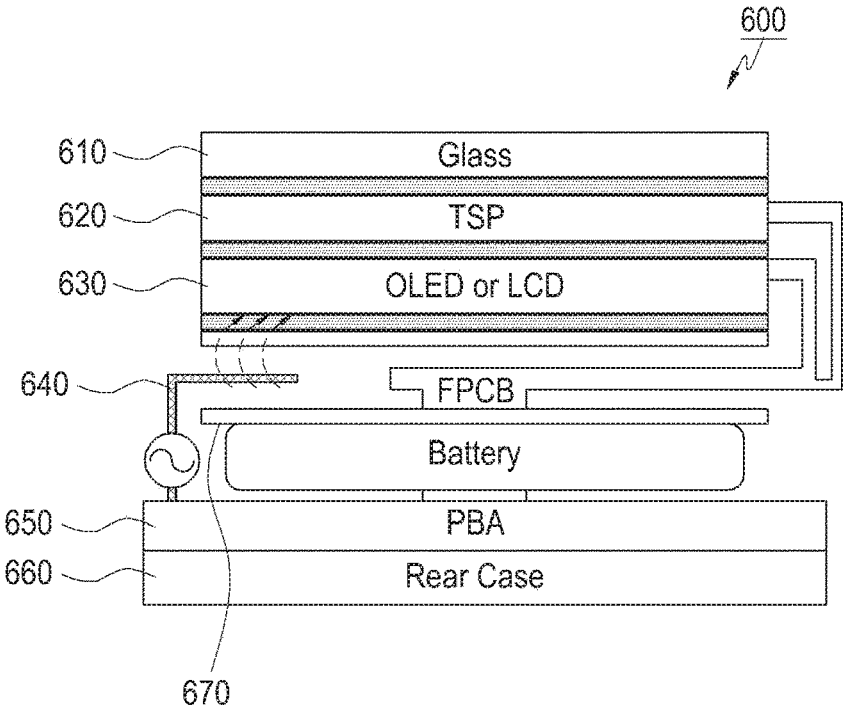
FIG. 9 is a cross-sectional side view illustrating the configuration of an electronic device according to an embodiment of the present disclosure.

FIG. 9 is a cross-sectional side view illustrating another configuration of an electronic device that utilizes a conductive layer (not shown) of a display as an antenna radiator according to an embodiment of the present disclosure.

Referring to FIG. 9, the electronic device 600 may include a window 610, a touch panel 620, a display 630 including a conductive layer, a signal power supply part 640, a substrate 650, and a rear case 660. The window 610, the touch panel 620, the display 630, the signal power supply part 640, and the rear case 660 have the same configuration as that of the embodiment shown in FIG. 2A above, so the detailed description thereof will be omitted. An extended ground 670 may be further provided to be electrically connected to the substrate under the signal power supply part 640 for a stable antenna operation when the conductive layer of the display is implemented as an antenna radiator. The signal power supply part 640 may be electrically coupled to the conductive layer of the display 630 to use the same as an antenna of the electronic device 600, and the substrate 650 may be electrically connected to the signal power supply part 640, and may transmit and receive a signal of the antenna radiator of the conductive layer through the signal power supply part 640. The extended ground 670 may be provided for a stable antenna operation of the conductive layer. For example, the extended ground 670 may implement a stable antenna operation of the conductive layer when utilizing the conductive layer as an antenna radiator in order to thereby improve the performance of the antenna.

According to various embodiments of the present disclosure, a ground may be provided under the signal power supply part.

Figure 10:
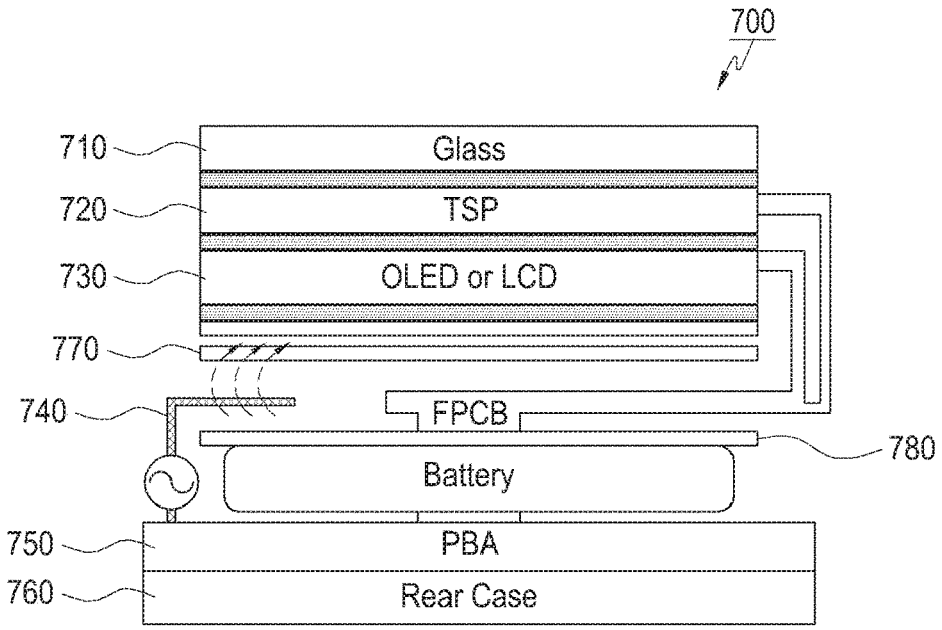
FIG. 10 is a cross-sectional side view illustrating the configuration of an electronic device according to an embodiment of the present disclosure.

FIG. 10 is a cross-sectional side view illustrating the configuration of an electronic device according to an embodiment of the present disclosure.

Referring to FIG. 10, the electronic device 700 may include a window 710, a touch panel 720, a display 730, a signal power supply part 740, a patch antenna 770, a substrate 750, and a rear case 760. The window 710, the touch panel 720, the display 730, and the rear case 760 have the same configuration as that of the embodiment shown in FIG. 2A above, so the detailed description thereof will be omitted. The patch antenna 770 may be provided between the display 730 and the signal power supply part 740. The signal power supply part 740 may be electrically coupled to the patch antenna 770 in order to use the patch antenna 770 as an antenna of the electronic device 700. The substrate may be electrically connected to the signal power supply part 740, and may transmit and receive a signal of the antenna radiator of the patch antenna 770 through the signal power supply part 740.

Accordingly, the patch antenna 770 may be separately provided between the display 730 and the signal power supply part 740 so as to be used as an antenna of the electronic device 700, and an extended ground may be further provided under the signal power supply part so as to be electrically connected to the substrate for a stable antenna operation of the patch antenna. The signal power supply part 740 may be electrically coupled to the patch antenna 770 to use the patch antenna 770 as an antenna of the electronic device 700, and the substrate 750 may be electrically connected to the signal power supply part 740 to transmit and receive an antenna signal of the patch antenna through the signal power supply part. The extended ground 780 may provide the implementation of a stable antenna operation of the patch antenna 770. For example, the extended ground 780 may implement a stable antenna operation of the patch antenna when utilizing the patch antenna as an antenna in order to thereby improve the performance of the antenna.

According to an embodiment of the present disclosure, a patch antenna may be provided between the display and the signal power supply part, and an extended ground may be provided under the signal power supply part so as to be electrically connected to the substrate for a stable antenna operation when utilizing the patch antenna as an antenna radiator.

Figure 11:
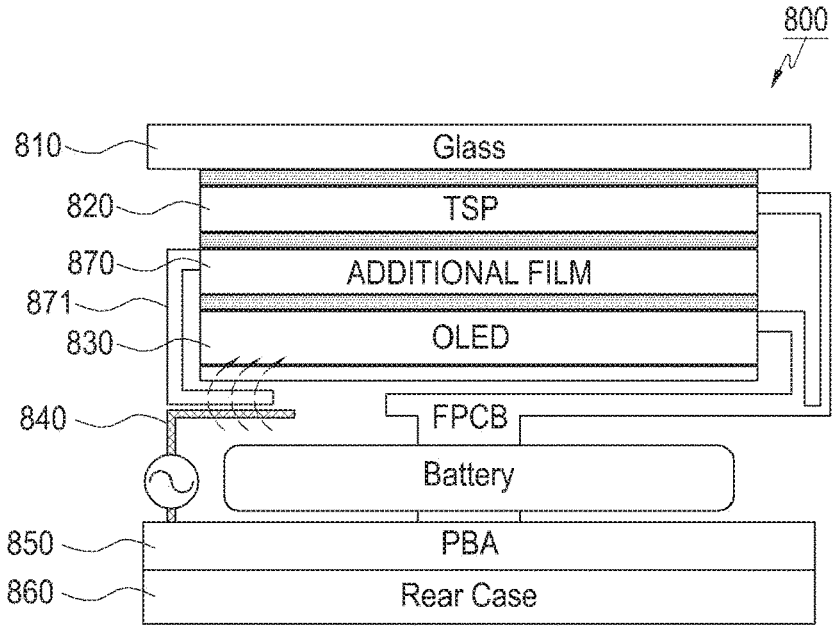
FIG. 11 is a cross-sectional side view illustrating the configuration of an electronic device that includes a film according to an embodiment of the present disclosure.

FIG. 11 is a cross-sectional side view illustrating another configuration of an electronic device that utilizes the conductive layer of the display as an antenna radiator according to an embodiment of the present disclosure.

Referring to FIG. 11, the electronic device 800 may include a window 810, a touch panel 820, a display 830 including a conductive layer (not shown), a signal power supply part 840, a substrate 850, a rear case 860, and a film 870. The window 810, the touch panel 820, the display 830, the signal power supply part 840, and the rear case 860 have the same configuration as that of the embodiment shown in FIG. 2A above, so the detailed description thereof will be omitted. A film 870 that is coupled to the signal power supply part 840 may be further provided between the touch panel 820 and the display 830. The signal power supply part 840 may be electrically coupled to the conductive layer of the display 830 to use the conductive layer as an antenna of the electronic device 800, and may also be coupled to the film 870. The substrate 850 may be electrically connected to the signal power supply part 840, and may transmit and receive a signal of an antenna radiator of the conductive layer and a signal of an antenna radiator of the film 870 through the signal power supply part 840. The film 870 may be provided with a coupling power supply part 871 that is coupled to the signal power supply part 840. For example, the coupling power supply part 871 may be provided on the side of the film 870, and may face the signal power supply part 840 for coupling. The coupling power supply part 871 may have a coupling surface formed to face the surface of the signal power supply part 840.

In addition, the film 870 may be configured to include a metal mesh film to be utilized as an antenna radiator.

The electronic device 800, according to various embodiments of the present disclosure, may utilize the conductive layer of the display 830 and the additional film 870 as antenna radiators, and the signal power supply part 840 may be simultaneously coupled to the conductive layer and the film 870 in order to thereby clearly form a radiation pattern of the antenna radiator and in order to thereby improve the antenna performance of the electronic device.

Figure 12:
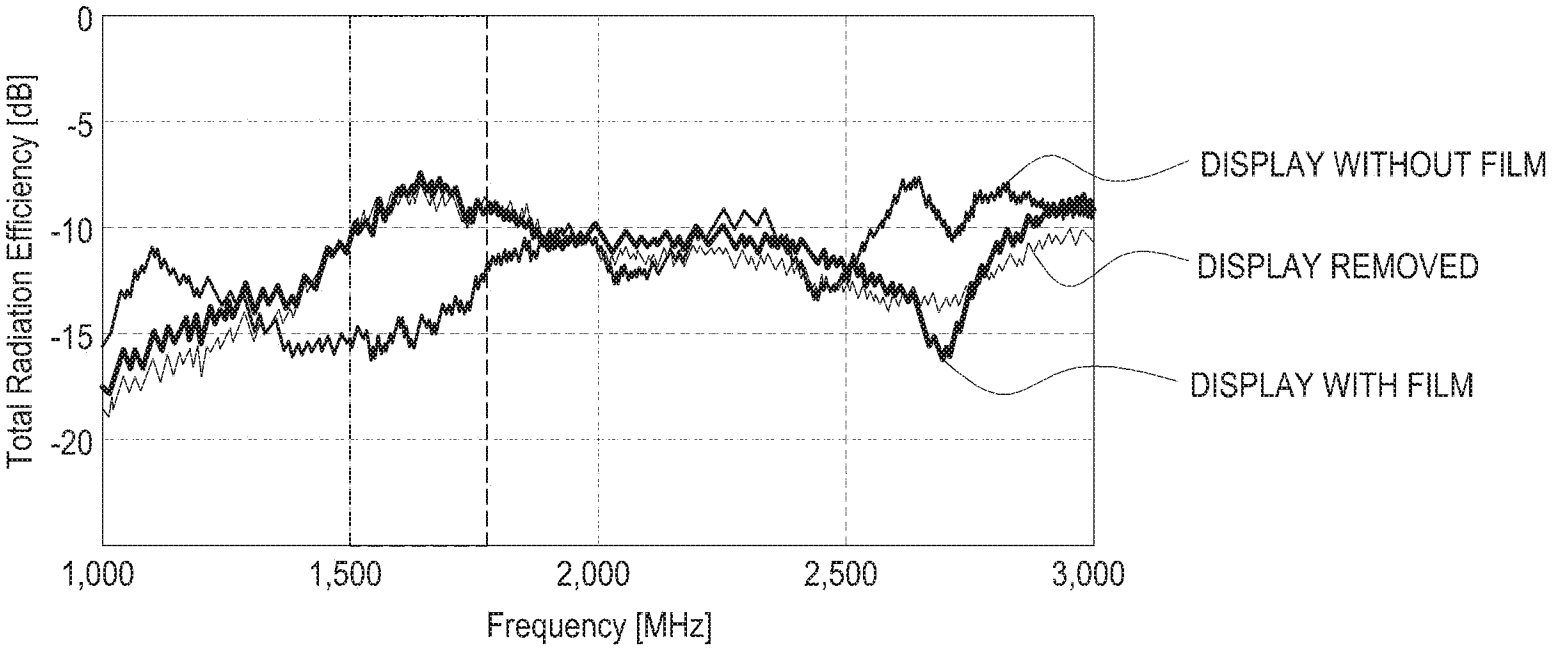
FIG. 12 is a graph showing the antenna radiation efficiency of an electronic device that includes a film according to an embodiment of the present disclosure.

FIG. 12 is a graph illustrating the antenna radiation efficiency of an electronic device that further includes a film according to an embodiment of the present disclosure.

Referring to FIG. 12, the graph shows the antenna radiation efficiency of the electronic device when a film is further applied to the electronic device and the conductive layer of the display and the film are simultaneously used as antenna radiators. As shown in the graph, the antenna radiation efficiency of the electronic device is improved, and, particularly, there is a big difference in the antenna radiation efficiency between the case where the conductive layer and the film are applied and the case where the conductive layer and the film are not applied in a frequency band of 1,500 to 2,000 MHz. For example, the antenna radiation efficiency is improved when using only the conductive layer of the display and when using the conductive layer and the film at the same time in the electronic device, whereas the antenna radiation efficiency is lowered when the conductive layer and the film are not used.

Accordingly, when using only the conductive layer of the display in the electronic device and when applying and using the conductive layer and the film at the same time in the electronic device, the antenna performance may be improved due to the improvement of the antenna radiation efficiency.

According to various embodiments of the present disclosure, a film to be coupled to the signal power supply part may be provided between the touch panel and the display in order to utilize the same as an antenna radiator.

According to various embodiments of the present disclosure, the film may be configured to include a metal mesh film.

According to various embodiments of the present disclosure, the film may be provided with a coupling power supply part that is coupled to the signal power supply part.

Figure 13:
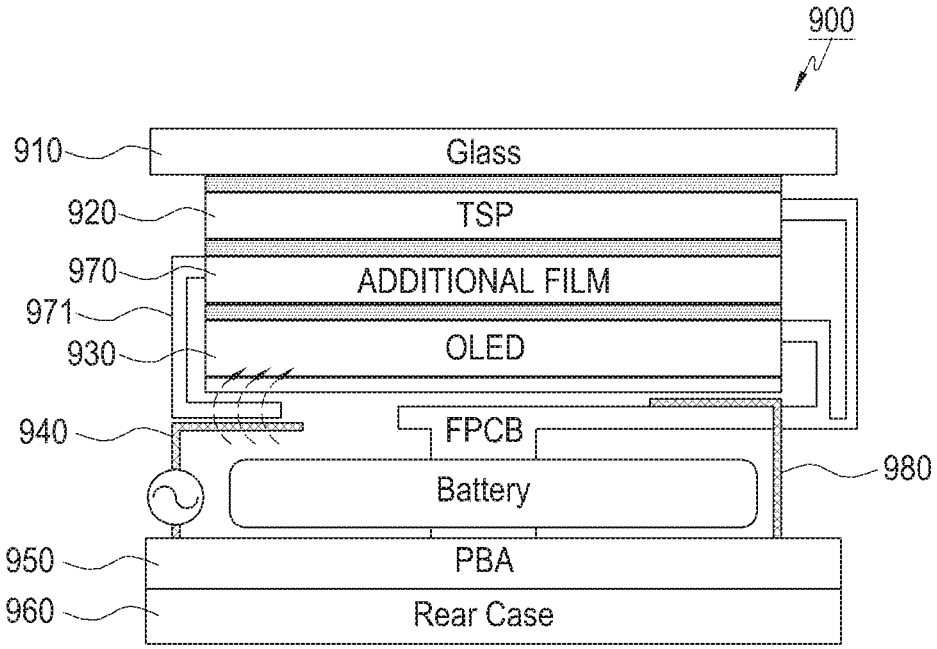
FIG. 13 is a cross-sectional side view illustrating the configuration of an electronic device that includes a film and a shorting part according to an embodiment of the present disclosure.

FIG. 13 is a cross-sectional side view illustrating another configuration of an electronic device that utilizes the conductive layer of the display as an antenna radiator according to an embodiment of the present disclosure.

Referring to FIG. 13, the electronic device 900 may include a window 910, a touch panel 920, a displayed 930 including a conductive layer (not shown), a signal power supply part 940, a substrate 950, a rear case 960, a film 970, and a shorting part 980. The window 910, the touch panel 920, the display 930, the signal power supply part 940, and the rear case 960 have the same configuration as that of the embodiment shown in FIG. 2A above, so the detailed description thereof will be omitted. The film 970 that is coupled to the signal power supply part 940 may be provided between the touch panel 920 and the display 930. Additionally, a shorting part 980 may be provided under the display 930 in order to implement an antenna of a multi-band by utilizing the conductive layer as an antenna radiator and by utilizing the film 970 as an antenna radiator. The signal power supply part 940 may be electrically coupled to the conductive layer of the display 930 and the film 970 at the same time to use the same antennas of the electronic device 900. The substrate 950 may be electrically connected to the signal power supply part 940, and may transmit and receive an antenna radiator signal of the conductive layer and an antenna radiator signal of the film 970 through the signal power supply part 940. The film 970 may be provided with a coupling power supply part 971 that is coupled to the signal power supply part 940. The coupling power supply part 971 has the same configuration as the coupling power supply part of the embodiment shown in FIG. 11, so the detailed description thereof will be omitted.

The electronic device 900, according to various embodiments of the present disclosure, may utilize the conductive layer of the display 930 and the film 970 as antenna radiators, and may further adopt the shorting part 980 in addition thereto, thereby utilizing the conductive layer as an antenna of a multi-band by using the shorting part as a bandpass filter.

The multi-band may be configured to include Bluetooth (BT), GPS, and Wi-Fi, and other bands (for example, second generation (2G), third generation (3G), fourth generation (4G), fifth generation (5G), NFC, Zigbee, or the like) other than the multi-band described above may also be applied.

Figure 14:
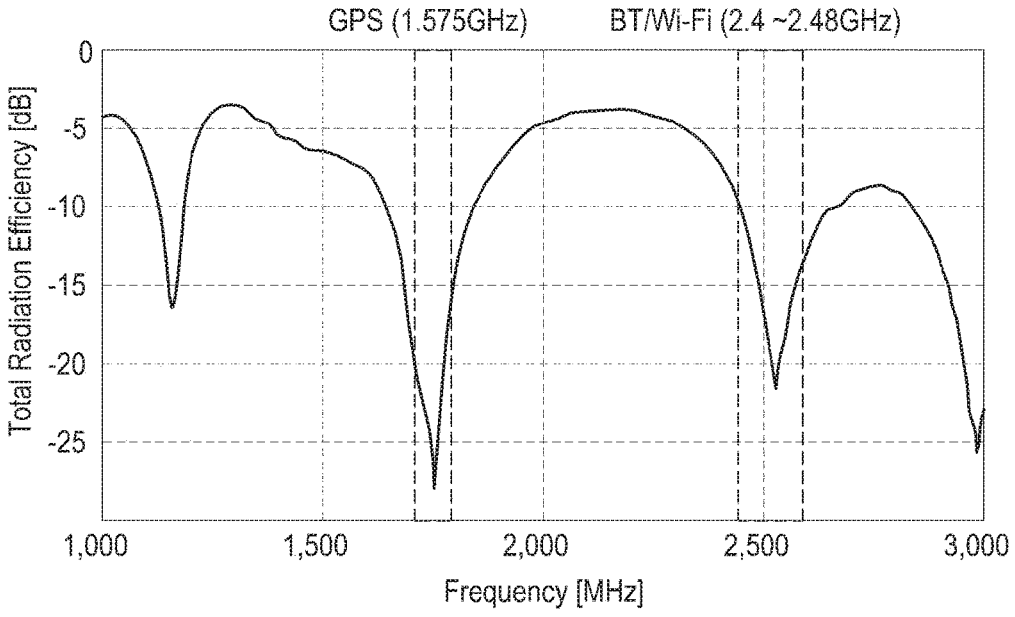
FIG. 14 is a graph showing the radiation performance of an electronic device that includes a film and a shorting part according to an embodiment of the present disclosure.

FIG. 14 is a graph illustrating the radiation performance of an electronic device that further includes a film and a shorting part according to an embodiment of the present disclosure.

Referring to FIG. 14, the graph shows the antenna radiation efficiency of the electronic device when a film and a shorting part are further applied to the electronic device; the conductive layer of the display and the film are used as antenna radiators; a shorting part 980 is further provided; and the shorting part is utilized as a bandpass filter in order to thereby use an antenna of a multi-band. The graph shows that the antenna radiation efficiency of the electronic device is improved. In particular, as shown in FIG. 14, when an antenna of the multi-band is applied, it may be used in a frequency band of 1.575 GHz in GPS, and it may also be used in a frequency band of 2.4 to 2.48 GHz in BT and Wi-Fi.

For example, the antenna radiation efficiency is improved by applying and using the conductive layer of the display and the film at the same time in the electronic device. The shorting part may be further utilized as a bandpass filter in order to thereby use the same as an antenna even in a multi-band, such as a frequency band of GPS, BT, and Wi-Fi.

Therefore, it is possible to improve the antenna radiation efficiency of the electronic device by simultaneously using the conductive layer of the display and the film and by further applying the shorting part, and it is possible to implement the conductive layer as an antenna of a multi-band by utilizing the shorting part as a bandpass filter.

According to various embodiments of the present disclosure, a film may be provided between the touch panel and the display so as to be coupled to the signal power supply part in order to utilize the same as an antenna radiator, and a shorting part may be provided under the display to implement a multi-band antenna by utilizing the conductive layer as an antenna radiator.

Figure 15:
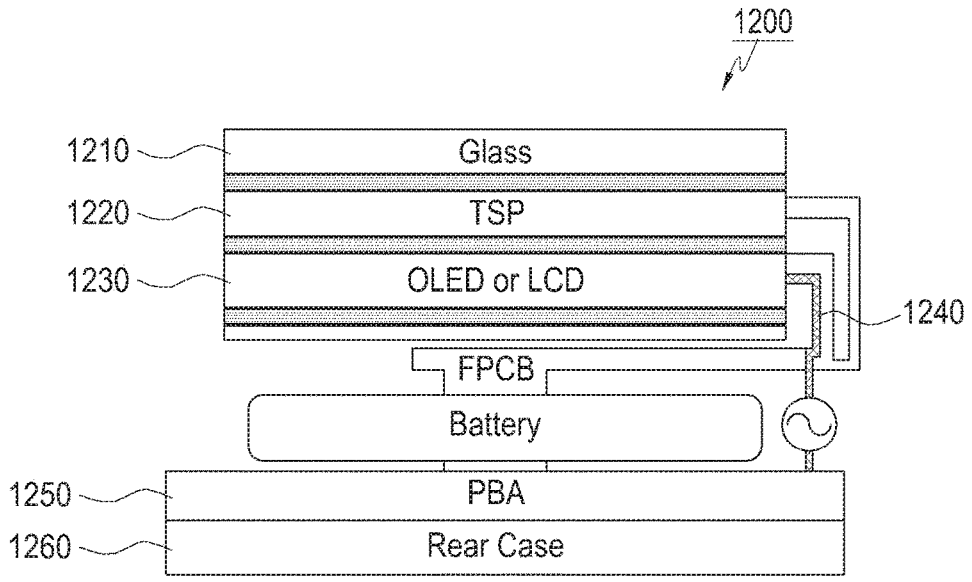
FIG. 15 is a cross-sectional side view illustrating the configuration of an electronic device that includes a signal power supply part that is directly and electrically connected to a display according to an embodiment of the present disclosure.
Figure 16:
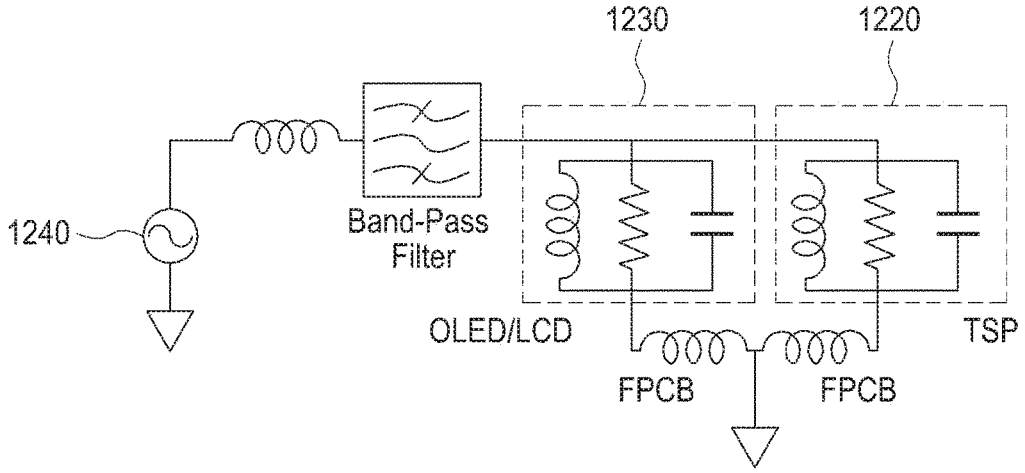
FIG. 16 is an equivalent circuit diagram illustrating the configuration of an electronic device that includes a signal power supply part that is directly and electrically connected to a display according to an embodiment of the present disclosure.
Figure 17:
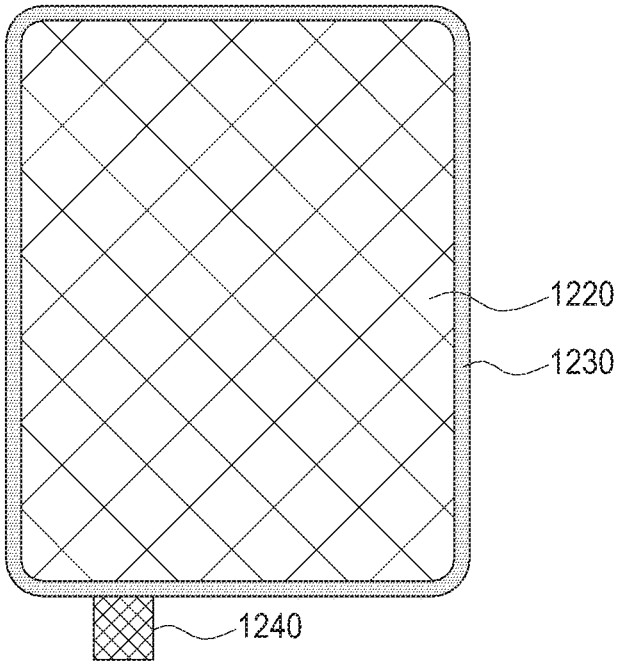
FIG. 17 is a view illustrating a signal power supply part that is directly and electrically connected to a display among the components of an electronic device according to an embodiment of the present disclosure.

FIG. 15 is a cross-sectional side view illustrating the configuration of an electronic device that includes a signal power supply part that is directly and electrically connected to a display according to an embodiment of the present disclosure, and FIG. 16 is an equivalent circuit diagram illustrating the configuration of an electronic device that includes a signal power supply part that is directly and electrically connected to a display according to an embodiment of the present disclosure. FIG. 17 is a view illustrating a signal power supply part that is directly and electrically connected to a display among the components of an electronic device according to an embodiment of the present disclosure.

Referring to FIGS. 15 to 17, the electronic device 1200 may include a window 1210, a touch panel 1220, a display 1230 including a conductive layer (not shown), a signal power supply part 1240 that is directly and electrically connected to the conductive layer, a substrate 1250, and a rear case 1260. The window 1210, the touch panel 1220, the display 1230, and the rear case 1260 have the same configuration as that of the embodiment shown in FIG. 2A above, so the detailed description thereof will be omitted.

The signal power supply part 1240 may be provided on one side of the display 1230, and may be directly and electrically connected to the substrate 1250 so as to directly apply a signal of an antenna radiator of the conductive layer of the display 1230 to the substrate 1250.

The signal power supply part 1240 may be configured such that the first end of the signal power supply part 1240 is directly and electrically connected to the conductive layer of the display 1230 and the second end on the opposite side of the first end of the signal power supply part 1240 is directly and electrically connected to the substrate 1250, instead of a configuration in which the signal power supply part 1240 is wirelessly coupled to the conductive layer of the display 1230.

For example, the first end of the signal power supply part 1240 may be directly and electrically connected to the conductive layer of the display 1230 and the second end on the opposite side of the first end of the signal power supply part 1240 may be directly and electrically connected to the substrate 1250 in order to thereby improve the utilization and electrical connection of the antenna radiator of the conductive layer by means of the signal power supply part. In addition, it is possible to prevent the deterioration of the visibility of the display because a typical antenna is not required to be separately provided in the electronic device 1200, and since a separate mounting space and active area is not required, the slimness and miniaturization of the electronic device 1200 can be achieved.

According to various embodiments of the present disclosure, the signal power supply part may be directly and electrically connected to the conductive layer.

Figure 18:
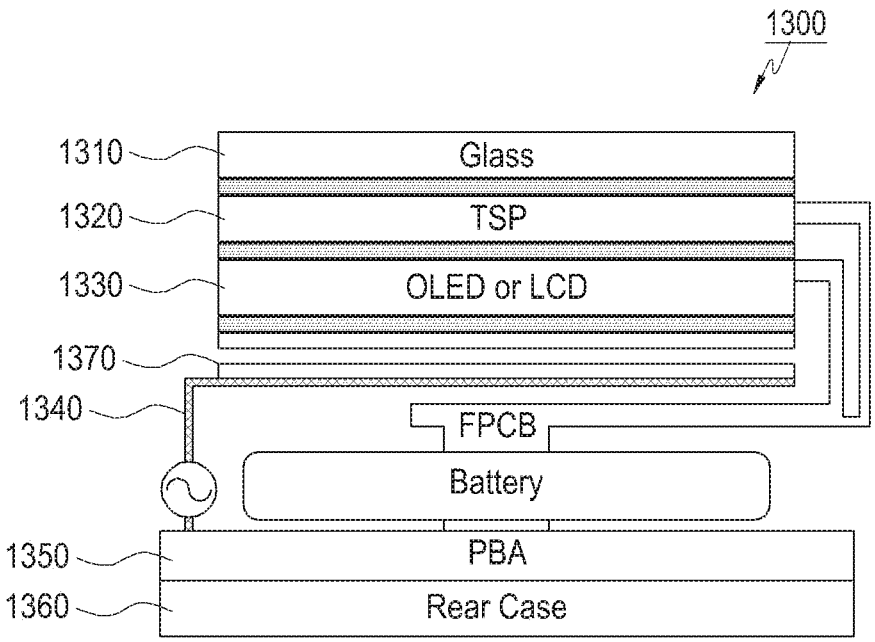
FIG. 18 is a cross-sectional side view illustrating a signal power supply part that is directly and electrically connected to a patch antenna among the components of an electronic device according to an embodiment of the present disclosure.

FIG. 18 is a cross-sectional side view illustrating a signal power supply part that is directly and electrically connected to a patch antenna among the components of an electronic device 1300 according to an embodiment of the present disclosure.

Referring to FIG. 18, the electronic device 1300 may include a window 1310, a touch panel 1320, a display 1330, a signal power supply part 1340, a patch antenna 1370, a substrate 1350, and a rear case 1360. The window 1310, the touch panel 1320, the display 1330, and the rear case 1360 have the same configuration as that of the embodiment shown in FIG. 2A above, so the detailed description thereof will be omitted. The patch antenna 1370 may be disposed between the display 1330 and the signal power supply part 1340. The signal power supply part 1340 may be directly and electrically connected to the patch antenna 1370 to use the same as an antenna of the electronic device 1300. The substrate 1350 may be electrically connected to the signal power supply part 1340, and may transmit and receive an antenna radiator signal of the patch antenna 1370 through the signal power supply part 1340.

For example, the first end of the signal power supply part 1340 may be directly and electrically connected to the patch antenna 1370 and the second end on the opposite side of the first end of the signal power supply part 1340 may be directly and electrically connected to the substrate 1350.

Accordingly, the patch antenna 1370 may be separately provided between the display 1330 and the signal power supply part 1340, and the signal power supply part 1340 may directly and electrically connect the patch antenna 1370 and the substrate 1350 in order to thereby facilitate an electrical connection of the patch antenna 1370 and the substrate 1350 and in order to thereby improve the use of the antenna of the electronic device 1300.

According to various embodiments of the present disclosure, the patch antenna may be provided between the display and the signal power supply part.

Figure 19:
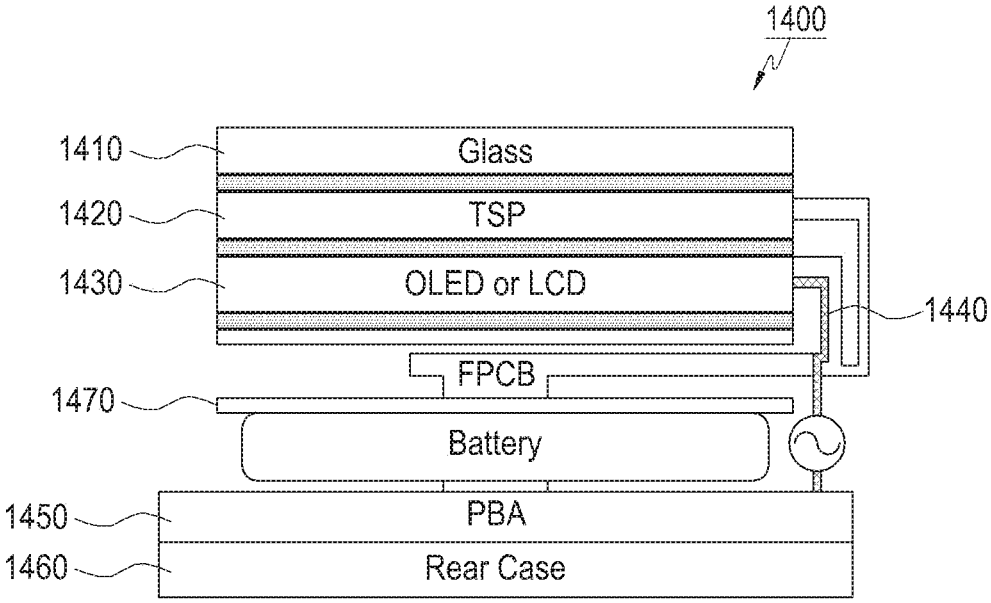
FIG. 19 is a cross-sectional side view illustrating a signal power supply part that is directly and electrically connected to a ground and a display among the components of an electronic device according to an embodiment of the present disclosure.

FIG. 19 is a cross-sectional side view illustrating a signal power supply part that is directly and electrically connected to a ground and a display among the components of an electronic device according to an embodiment of the present disclosure.

Referring to FIG. 19, the electronic device 1400 may include a window 1410, a touch panel 1420, a display 1430 including a conductive layer (not shown), a signal power supply part 1440, a substrate 1450, and a rear case 1460. The window 1410, the touch panel 1420, the display 1430, and the rear case 1460 have the same configuration as that of the embodiment shown in FIG. 2A above, so the detailed description thereof will be omitted. An extended ground 1470 may be further provided between the display 1430 and the substrate 1450 so as to be electrically connected to the substrate for a stable antenna operation of the conductive layer when utilizing the conductive layer of the display as an antenna radiator. The first end of the signal power supply part 1440 may be directly and electrically connected to the conductive layer of the display 1430, and the second end on the opposite side of the first end of the signal power supply part 1440 may be directly and electrically connected to the substrate 1450. Accordingly, an antenna radiator signal of the conductive layer of the display 1430 may be directly applied to the substrate 1450 through the signal power supply part 1440. The extended ground may provide the implementation of a stable antenna operation of the conductive layer when utilizing the conductive layer of the display 1430 as an antenna radiator in order to thereby improve the performance of the antenna.

According to the various embodiments of the present disclosure, an extended ground may be further provided between the display and the substrate so as to be electrically connected to the substrate for a stable antenna operation when utilizing the conductive layer of the display as an antenna radiator.

Figure 20:
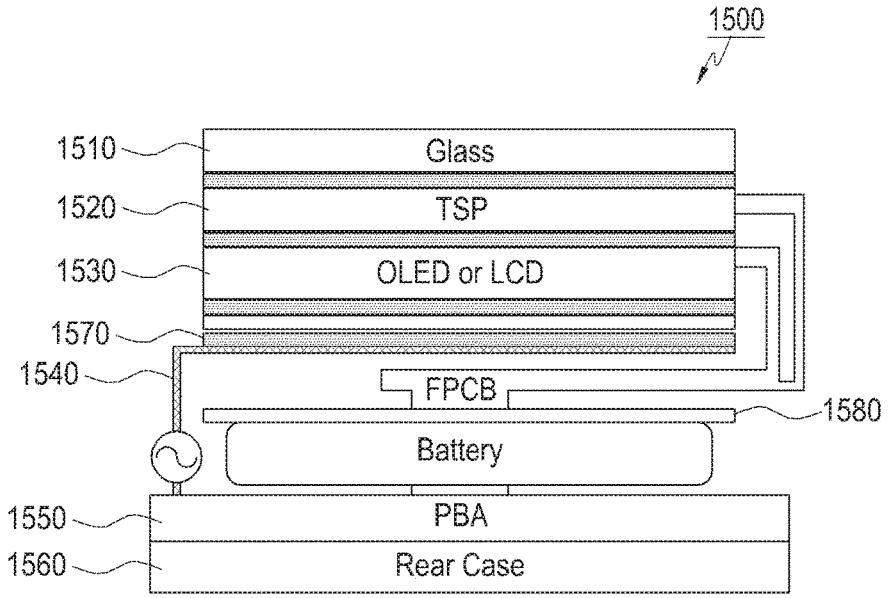
FIG. 20 is a cross-sectional side view illustrating a signal power supply part that is directly and electrically connected to a ground and a patch antenna among the components of an electronic device according to an embodiment of the present disclosure.

FIG. 20 is a cross-sectional view illustrating a signal power supply part that is directly and electrically connected to a ground and a patch antenna among the components of an electronic device according to an embodiment of the present disclosure.

Referring to FIG. 20, the electronic device 1500 may include a window 1510, a touch panel 1520, a display 1530, a signal power supply part 1540, a patch antenna 1570, a substrate 1550, and a rear case 1560. The window 1510, the touch panel 1520, the display 1530, and the rear case 1560 have the same configuration as that of the embodiment shown in FIG. 2A above, so the detailed description thereof will be omitted. The patch antenna 1570 may be provided between the display 1530 and the signal power supply part 1540. The first end of the signal power supply part 1540 may be directly and electrically connected to the patch antenna 1570, and the second end on the opposite side of the first end of the signal power supply part 1540 may be directly and electrically connected to the substrate 1550. The signal power supply part 1540 may directly and electrically connect the patch antenna 1570 and the substrate 1550 in order to thereby apply an antenna radiator signal of the patch antenna 1570 to the substrate 1550.

Accordingly, it is possible to directly and stably apply antenna signals of the patch antenna to the substrate 1550 by configuring the signal power supply part 1540 that directly and electrically connect the patch antenna 1570 and the substrate 1550 and by further providing the extended ground 1580 under the patch antenna 1570 and the substrate 1550. The extended ground 1580 may be provided for a stable antenna operation of the patch antenna 1570. The extended ground 1580 may provide a stable antenna operation of the patch antenna when utilizing the patch antenna 1570 as an antenna in order to thereby improve the performance of the antenna.

According to various embodiments of the present disclosure, a patch antenna may be provided between the display and the signal power supply part, and an extended ground may be provided between the patch antenna and the substrate so as to be electrically connected to the substrate for a stable antenna operation when utilizing the conductive layer of the display as an antenna radiator.

Figure 21:
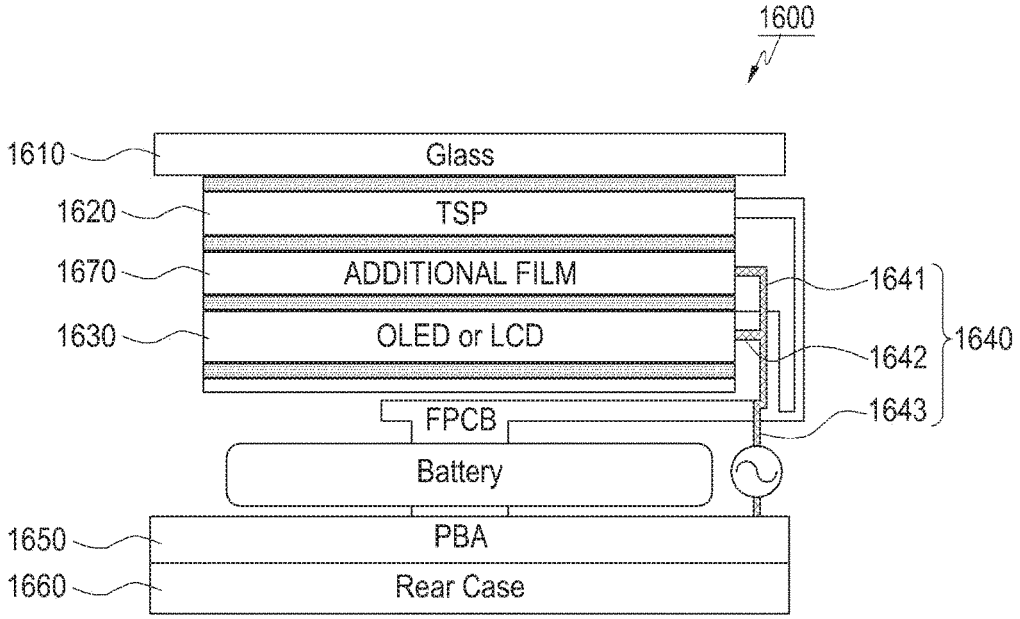
FIG. 21 is a cross-sectional side view illustrating the configuration of an electronic device that includes a signal power supply part that is directly and electrically connected to a display and further includes a film, according to an embodiment of the present disclosure.

FIG. 21 is a cross-sectional side view illustrating the configuration of an electronic device that includes a signal power supply part that is directly and electrically connected to a display and further includes a film according to an embodiment of the present disclosure.

Referring to FIG. 21, the electronic device 1600 may include a window 1610, a touch panel 1620, a display 1630 including a conductive layer (not shown), a signal power supply part 1640, a substrate 1650, a rear case 1660, and a film 1670. The window 1610, the touch panel 1620, the display 1630, the signal power supply part 1640, and the rear case 1660 have the same configuration as that of the embodiment shown in FIG. 2A above, so the detailed description thereof will be omitted. The film 1670 that is directly and electrically connected to the signal power supply part 1640 may be further provided between the touch panel 1620 and the display 1630. The signal power supply part 1640 may be directly and electrically connected to the film 1670 and the conductive layer of the display 1630, and may also be directly and electrically connected to the substrate 1650. The substrate 1650 may be directly and electrically connected to the signal power supply part 1640, and may transmit and receive an antenna radiator signal of the conductive layer of the display 1630 and an antenna radiator signal of the film 1670 through the signal power supply part 1640. The signal power supply part 1640 may include first, second, and third power supply parts 1641, 1642, and 1643 in order to directly and electrically connect the film 1670 and the conductive layer of the display 1630.

The first power supply part 1641 may be provided on the side of the film 1670, and may be directly and electrically connected to the film 1670. The second power supply part 1642 may be provided on the side of the display 1630, and may be directly and electrically connected to the conductive layer of the display 1630. The third power supply part 1643 may be electrically connected to the first and second power supply parts 1641 and 1642, and may be directly and electrically connected to the substrate 1650.

The first and second power supply parts 1641 and 1642 of the signal power supply part 1640 may directly and electrically connect the film 1670 and the conductive layer of the display 1630 at the same time, and the third power supply part 1643 of the signal power supply part 1640 may be directly and electrically connected to the first and second power supply parts 1641 and 1642 and the substrate 1650 in order to thereby utilize the conductive layer of the display 1630 and the film 1670 as antenna radiators. Thus, it is possible to clearly form the radiation pattern of the antenna radiator and to improve the performance of the antenna.

According to various embodiments of the present disclosure, a film may be provided between the touch panel and the display so as to be directly and electrically connected to the signal power supply part in order to be utilized as an antenna radiator.

According to various embodiments of the present disclosure, the signal power supply part may directly and electrically connect the film and the conductive layer of the display at the same time, and the signal power supply part may include a first power supply part that is directly and electrically connected to the film; a second power supply part that is directly and electrically connected to the conductive layer of the display; and a third power supply part that is directly and electrically connected to the substrate.

Figure 22:
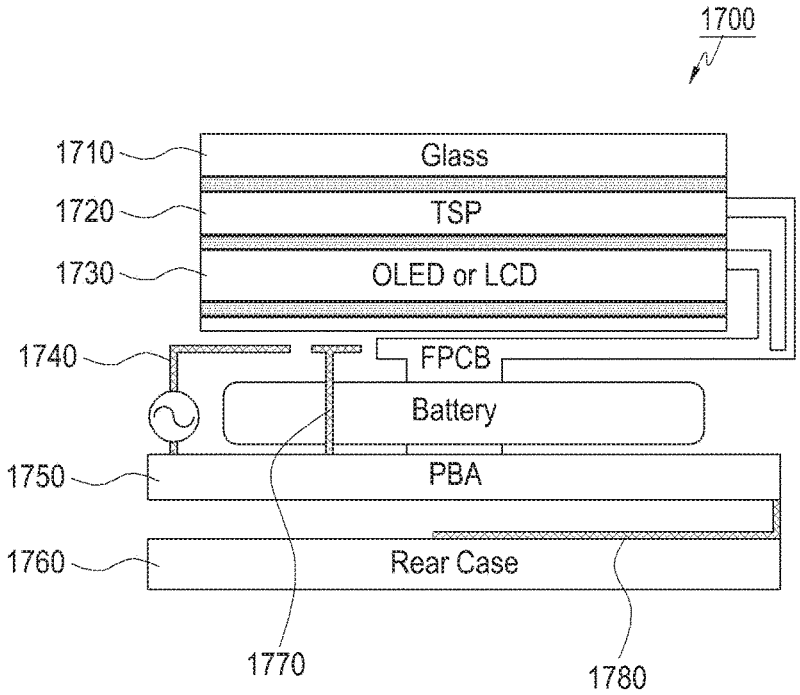
FIG. 22 is a cross-sectional side view illustrating the configuration of an electronic device for antenna frequency tuning according to an embodiment of the present disclosure.
Figure 23:
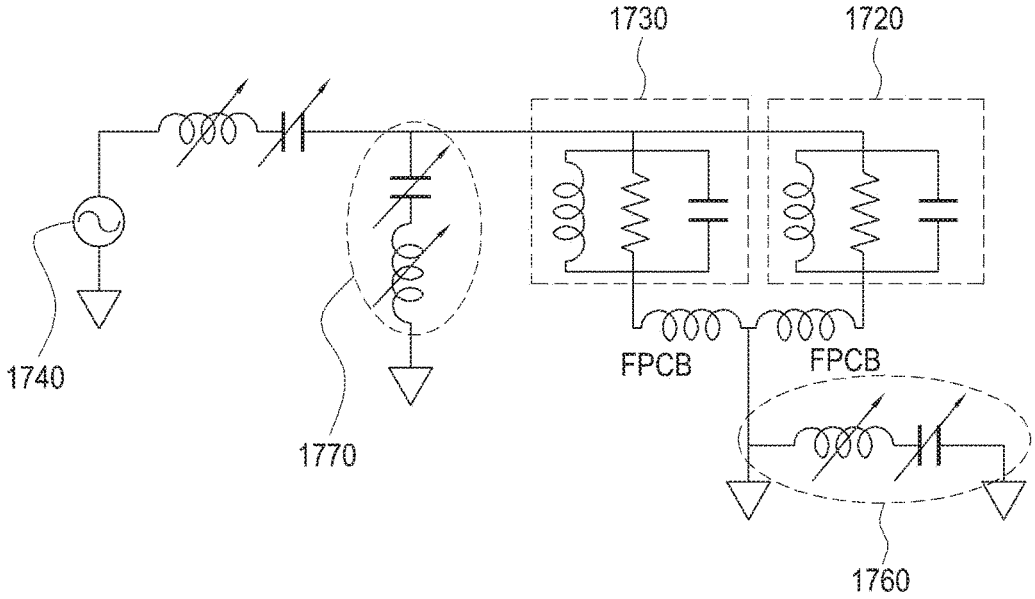
FIG. 23 is an equivalent circuit diagram illustrating the configuration of an electronic device for antenna frequency tuning according to an embodiment of the present disclosure.

FIG. 22 is a cross-sectional side view illustrating the configuration of an electronic device for antenna frequency tuning according to an embodiment of the present disclosure, and FIG. 23 is an equivalent circuit diagram illustrating the configuration of an electronic device for antenna frequency tuning according to an embodiment of the present disclosure.

Referring to FIGS. 22 and 23, the electronic device 1700 may include a window 1710, a touch panel 1720, a display 1730 including a conductive layer (not shown), a signal power supply part 1740, a shorting part 1770, a substrate 1750, a rear case 1760, and a ground 1780. The window 1710, the touch panel 1720, the display 1730, and the rear case 1760 have the same configuration as that of the embodiment shown in FIG. 2A above, so the detailed description thereof will be omitted.

The signal power supply part 1740 may be provided between the display 1730 and the substrate 1750 so as to be electrically coupled to the conductive layer of the display 1730 for the utilization of the conductive layer of the display 1730 as an antenna radiator and for frequency tuning of the antenna radiator.

A shorting part 1770 for frequency tuning of the antenna radiator may be further provided near the signal power supply part 1740.

The substrate 1750 may be electrically connected to the signal power supply part 1740 and the shorting part 1770, and may be provided between the signal power supply part 1740 and the rear case 1760 so as to receive an antenna radiator signal of the conductive layer of the display 1730 and a tuned signal of the shorting part 1770 through the signal power supply part 1740 and the shorting part 1770.

The ground 1780 may be provided between the substrate 1750 and the rear case 1760 so as to operate as a ground for the antenna radiator of the conductive layer of the display 1730 and for the frequency tuning of the shorting part 1770. For example, the ground 1780 may improve the antenna performance and the antenna frequency tuning when utilizing the conductive layer of the display 1730 as an antenna radiator and when utilizing the shorting part 1770 for the antenna frequency tuning.

The signal power supply part 1740 may adjust a reduction or increase in the resonant frequency by changing the shape of a power supply pad.

In addition, the added shorting part 1770 may adjust a reduction in the resonant frequency, and may induce an additional resonance.

The added ground 1780 may be provided to induce an additional resonance. For example, the ground may induce an additional resonance when utilizing the conductive layer of the display 1730 as an antenna radiator and when utilizing the shorting part 1770 for the antenna frequency tuning in order to thereby improve the antenna performance and the antenna frequency tuning.

The signal power supply part 1740 may be electrically connected to the conductive layer of the display 1730 and the shorting part 1770, and may be directly and electrically connected to the conductive layer of the display 1730 and the shorting part 1770. For example, the signal power supply part 1740 may be directly and electrically connected to the shorting part 1770 for the utilization of the conductive layer of the display 1730 as an antenna radiator and for the frequency tuning of the antenna radiator.

According to various embodiments of the present disclosure, the electronic device may include a window; a touch panel; a display that includes a conductive layer; a signal power supply part that is electrically coupled to the conductive layer for the utilization of the conductive layer as an antenna radiator and for the frequency tuning of the antenna radiator; a shorting part that is provided near the signal power supply part for the frequency tuning of the antenna radiator; a substrate that is electrically connected to the signal power supply part and the shorting part so as to transmit and receive an antenna radiator signal of the conductive layer and a tuned signal of the shorting part through the signal power supply part and the shorting part; a rear case that supports the substrate; and a ground that is provided under the substrate so as to be electrically connected to the substrate.

According to various embodiments of the present disclosure, the signal power supply part may adjust a reduction or increase in the resonant frequency by changing the shape of a power supply pad.

According to various embodiments of the present disclosure, the shorting part may adjust a reduction in the resonant frequency, and may induce an additional resonance.

According to various embodiments of the present disclosure, the ground may induce an additional resonance.

Figure 24:
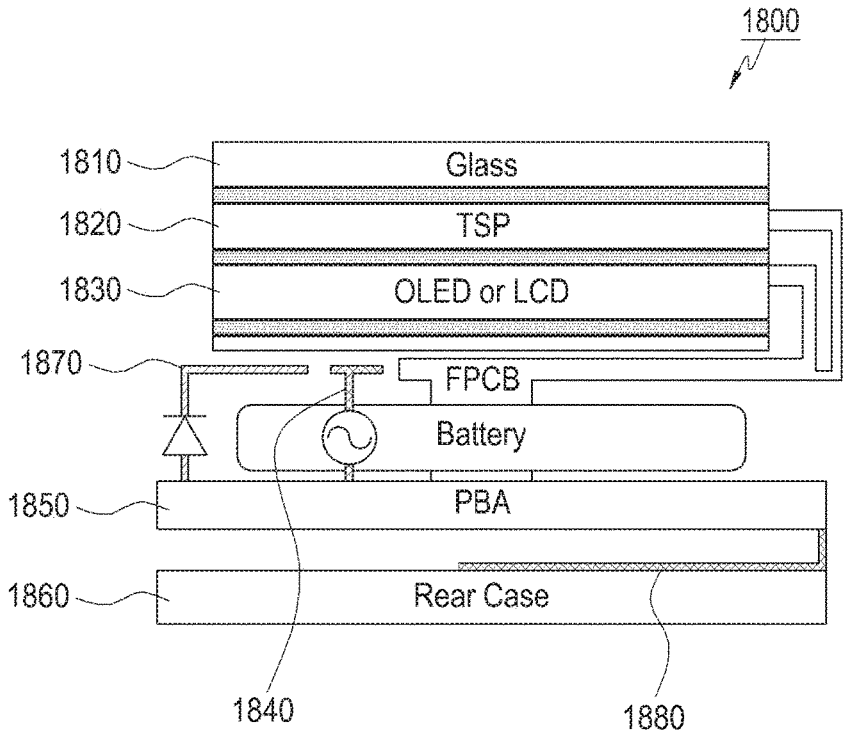
FIG. 24 is a cross-sectional side view illustrating the configuration of an electronic device for performing antenna frequency tuning by using an active element according to an embodiment of the present disclosure.
Figure 25:
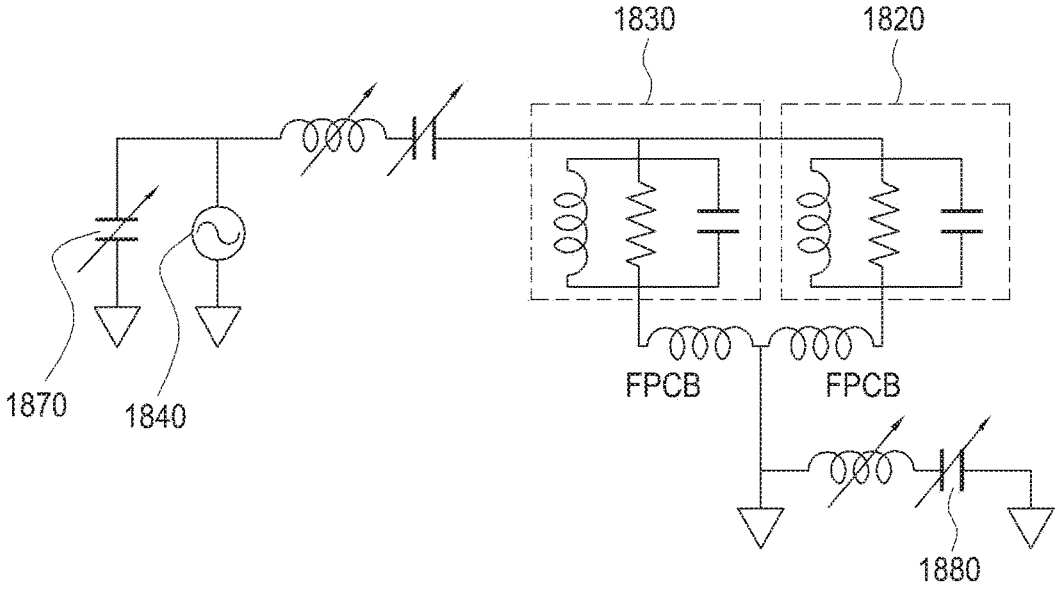
FIG. 25 is an equivalent circuit diagram illustrating the configuration of an electronic device for performing antenna frequency tuning by using an active element according to an embodiment of the present disclosure.

FIG. 24 is a cross-sectional side view illustrating the configuration of an electronic device for performing antenna frequency tuning by using an active element according to an embodiment of the present disclosure, and FIG. 25 is an equivalent circuit diagram illustrating the configuration of an electronic device for performing antenna frequency tuning by using an active element according to an embodiment of the present disclosure.

Referring to FIGS. 24 and 25, the electronic device 1800 may include a window 1810, a touch panel 1820, a display 1830 including a conductive layer (not shown), a signal power supply part 1840, an active element 1870, a substrate 1850, a rear case 1860, and a ground 1880. The window 1810, the touch panel 1820, the display 1830, and the rear case 1860 have the same configuration as that of the embodiment shown in FIG. 2A above, so the detailed description thereof will be omitted.

The signal power supply part 1840 may be provided between the display 1830 and the substrate 1850 so as to be electrically coupled to the conductive layer of the display 1830 for the utilization of the conductive layer of the display 1830 as an antenna radiator and for the frequency tuning of the antenna radiator.

The active element 1870 may be provided near the signal power supply part 1840 for the frequency tuning of the antenna radiator.

The substrate 1850 may be electrically connected to the signal power supply part 1840 and the active element 1870, and may be provided between the signal power supply part 1840 and the rear case 1860 so as to transmit and receive an antenna radiator signal of the conductive layer of the display 1830 and a tuned signal of the active element 1870 through the signal power supply part 1840 and the active element 1870.

The ground 1880 may be provided between the substrate 1850 and the rear case 1860 so as to operate as a ground 1880 for the antenna radiator of the conductive layer of the display 1830 and as a ground for the frequency tuning of the active element 1870. For example, the ground 1880 may be electrically connected to the substrate, and may induce an additional resonance. The ground 1880 may induce an additional resonance when utilizing the conductive layer of the display 1830 as an antenna radiator and when utilizing the active element 1870 for the antenna frequency tuning in order to thereby improve the antenna performance and the antenna frequency tuning.

The active element 1870 may be configured to include a varactor diode. Although the varactor diode is exemplified as the active element 1870, it is not limited thereto. Any element for the frequency tuning of the antenna radiator may be applied to the active element 1870.

In addition, a single active element 1870 may be disposed on the outer periphery of the display 1830 in the lower portion thereof.

The ground 1880 may be provided to induce an additional resonance. For example, the ground 1880 may improve the antenna performance and the antenna frequency tuning by inducing an additional resonance and by adjusting the resonant frequency when utilizing the conductive layer of the display 1830 as an antenna radiator and when utilizing the active element 1870 for the antenna frequency tuning.

In addition, the signal power supply part 1840 may be electrically coupled to the conductive layer of the display 1830 and the active element 1870, and may be directly and electrically connected to the conductive layer of the display 1830 and the active element 1870. For example, the signal power supply part 1840 may be directly and electrically connected to the active element 1870 for the utilization of the conductive layer of the display 1830 as an antenna radiator and for the frequency tuning of the antenna radiator.

According to various embodiments of the present disclosure, the electronic device 1800 may be further provided with a shorting part (not shown), and the shorting part may adjust the resonant frequency through the active element 1870 and a direct current (DC) biasing.

According to various embodiments of the present disclosure, the electronic device may include a window; a touch panel; a display that includes a conductive layer; a signal power supply part that is electrically coupled to the conductive layer for the utilization of the conductive layer as an antenna radiator and for the frequency tuning of the antenna radiator; an active element that is provided near the signal power supply part for the frequency tuning of the antenna radiator; a substrate that is electrically connected to the signal power supply part and the active element so as to transmit and receive a signal of the antenna radiator of the conductive layer and a frequency tuning signal of the active element through the signal power supply part and the active element; a rear case that supports the substrate; and a ground that is provided under the substrate so as to be electrically connected to the substrate to induce an additional resonance.

Figure 26:
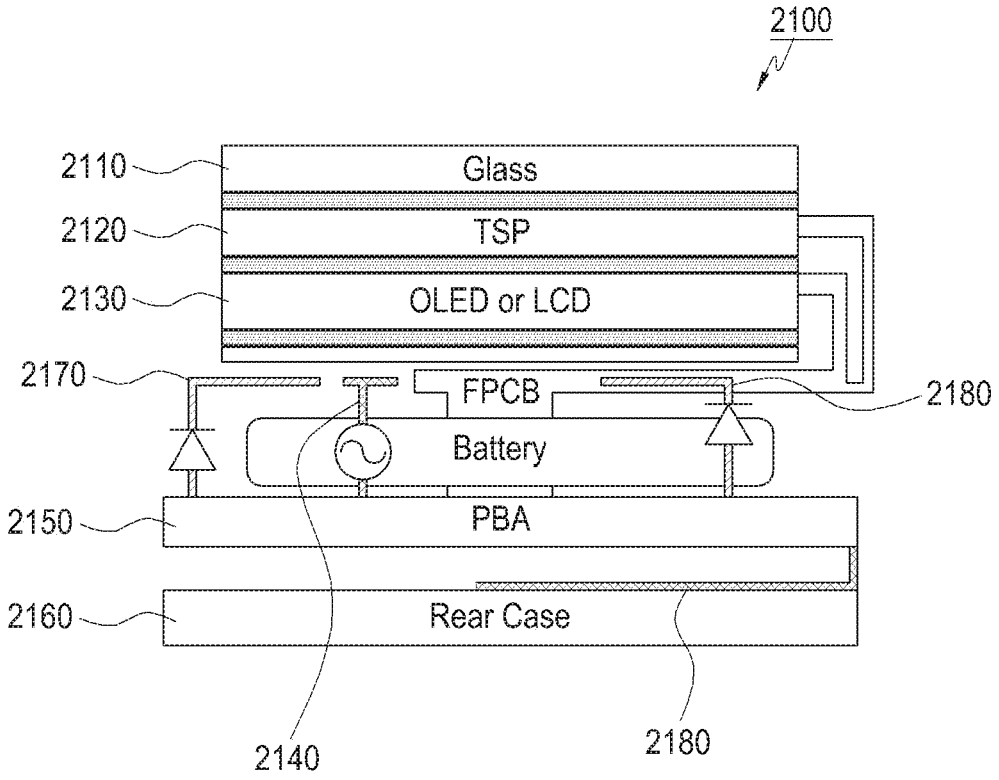
FIG. 26 is a cross-sectional side view illustrating the configuration of an electronic device for performing antenna frequency tuning by using a plurality of active elements according to an embodiment of the present disclosure.
Figure 27:
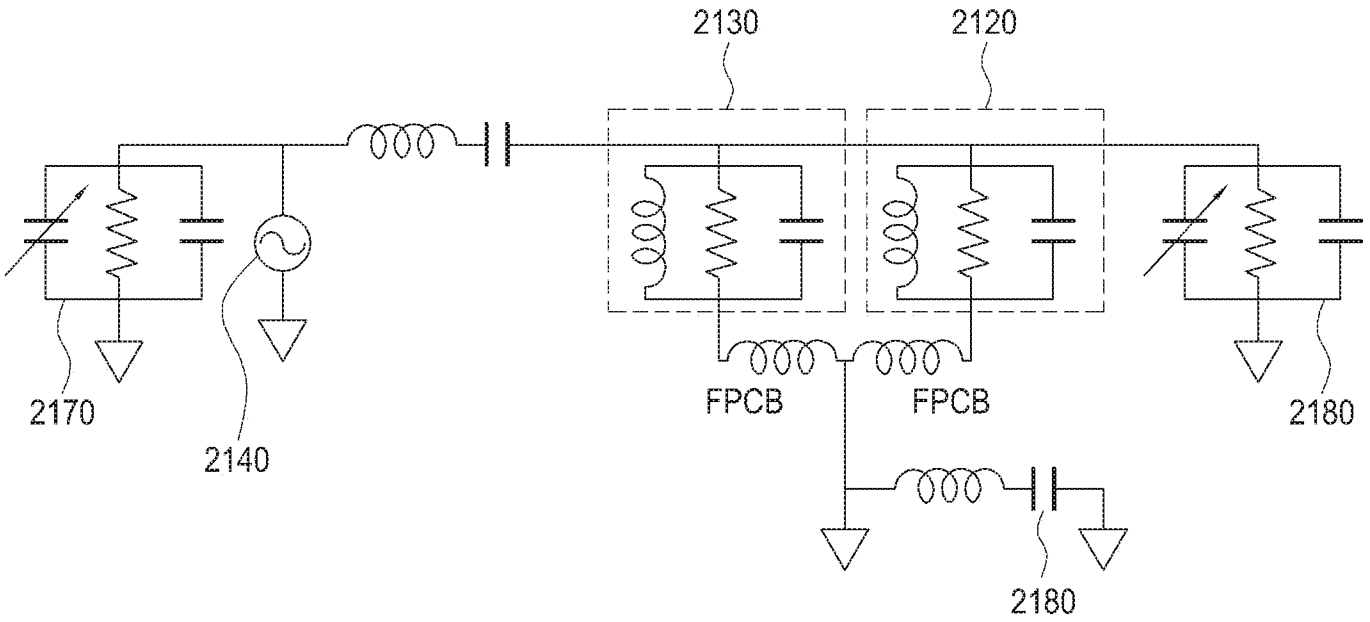
FIG. 27 is an equivalent circuit diagram illustrating the configuration of an electronic device for performing antenna frequency tuning by using a plurality of active elements according to an embodiment of the present disclosure.

According to various embodiments of the present disclosure, the active element may be configured to include a varactor diode FIG. 26 is a cross-sectional side view illustrating the configuration of an electronic device for performing antenna frequency tuning by using one or more active elements according to an embodiment of the present disclosure, and FIG. 27 is an equivalent circuit diagram illustrating the configuration of an electronic device for performing antenna frequency tuning by using a plurality of active elements according to an embodiment of the present disclosure.

Referring to FIGS. 26 and 27, the electronic device 2100 may include a window 2110, a touch panel 2120, a display 2130 including a conductive layer (not shown), a signal power supply part 2140, a plurality of active elements 1870, a substrate 2150, a rear case 2160, and a ground 2180. The window 2110, the touch panel 2120, the display 2130, and the rear case 2160 have the same configuration as that of the embodiment shown in FIG. 2A above, so the detailed description thereof will be omitted. A plurality of active elements 2170 may be provided in the electronic device 2100, and the plurality of active elements 2170 may be symmetrically disposed on both sides of the display 2130, or may be disposed along the outer periphery of the display 2130. For example, one or more active elements 2170 may be disposed in the radiating slots on both ends of the display 2130.

The ground 2180 may induce an additional resonance. For example, the ground 2180 may improve the antenna performance and the antenna frequency tuning by inducing an additional resonance and by adjusting the resonant frequency when utilizing the conductive layer of the display 2130 as an antenna radiator and when utilizing the plurality of active elements 2170 for the antenna frequency tuning.

The signal power supply part 2140 may be electrically coupled to the conductive layer of the display 2130 and the plurality of active elements 2170, and, according to an embodiment, the signal power supply part 2140 may be directly and electrically connected to the conductive layer of the display 2130 and the plurality of active elements 2170. For example, the signal power supply part 2140 may be directly and electrically connected to the plurality of active elements 2170 for the utilization of the conductive layer of the display 2130 as an antenna radiator and for the frequency tuning of the antenna radiator.

According to various embodiments of the present disclosure, a plurality of active elements are provided to be symmetrically disposed on both sides of the display or to be disposed along the outer periphery of the display.

Figure 28:
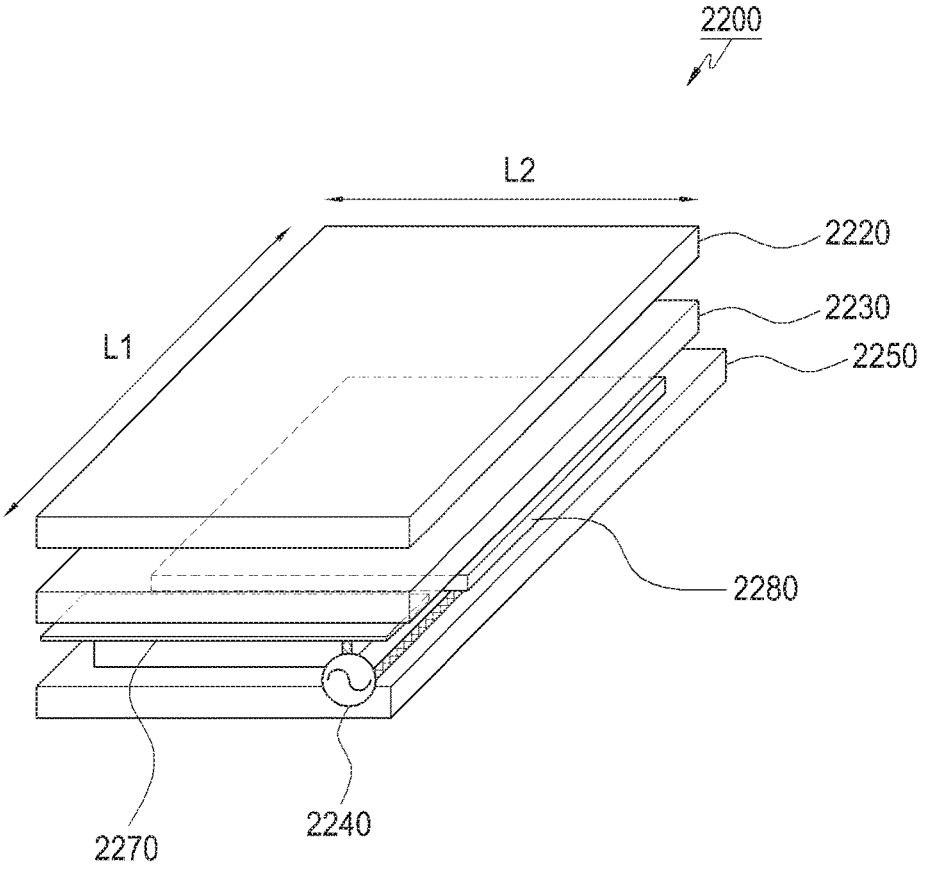
FIG. 28 is a perspective view illustrating the configuration of an electronic device that includes first and second pads according to an embodiment of the present disclosure.
Figure 29:
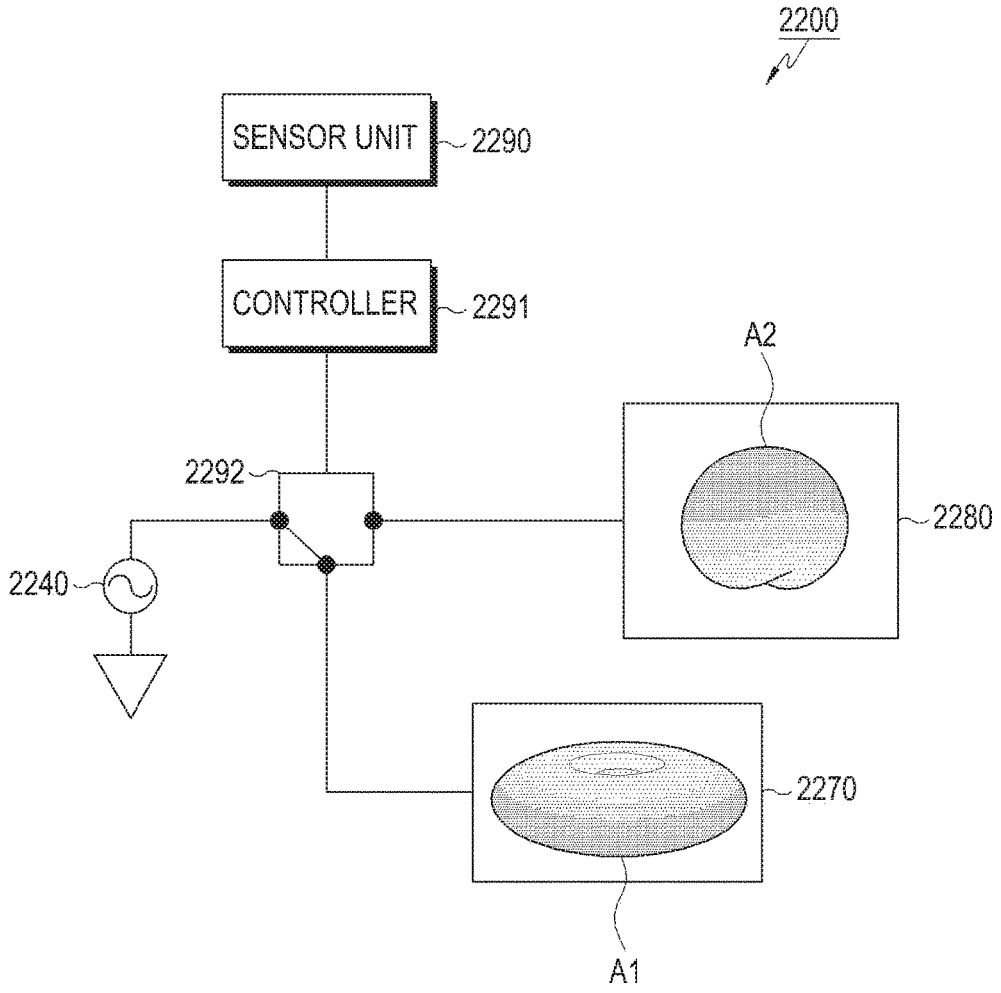
FIG. 29 is a circuit diagram illustrating the configuration of an electronic device for selecting an antenna beam pattern depending on the usage scenario according to an embodiment of the present disclosure.

FIG. 28 is a perspective view illustrating the configuration of an electronic device that includes first and second pads for selecting an antenna beam pattern depending on the usage scenario of the electronic device according to an embodiment of the present disclosure, and FIG. 29 is a circuit diagram illustrating the configuration of an electronic device for selecting an antenna beam pattern depending on the usage scenario according to an embodiment of the present disclosure.

Referring to FIGS. 28 and 29, the electronic device 2200 may include a window (not shown), a touch panel 2220, a display 2230 including a conductive layer (not shown), first and second pads 2270 and 2280, a sensor unit 2290, a controller 2291, a switch 2292, a signal power supply part 2240, a substrate 2250, and a rear case (not shown). The window (not shown), the touch panel 2220, the display 2230, and the rear case have the same configuration as that of the embodiment shown in FIG. 2A above, so the detailed description thereof will be omitted. The first pad 2270 may be electrically coupled to the conductive layer in order to utilize the conductive layer as an antenna radiator, and may also be provided between the display 2230 and the substrate 2250 so as to induce a one-wavelength resonance of the length (L1) of the electronic device 2200, thereby forming a beam pattern (A1) of the antenna.

The second pad 2280 may be electrically coupled to the conductive layer in order to utilize the conductive layer as an antenna radiator, and may also be provided between the display 2230 and the substrate 2250 so as to induce a half-wavelength resonance of the width (L2) of the electronic device, thereby forming a beam pattern (A2) of the antenna.

The sensor unit 2290 may detect motions (for example, usage scenarios) of the electronic device. Such motions may contain various usage scenarios.

The controller 2291 may determine the usage scenario of the electronic device 2200 by using the sensor unit 2290 to then control the switch 2292 to select the antenna beam pattern (A1) or (A2) through the first or second pad 2270 or 2280.

The usage scenarios, for example, may be configured to contain at least one of walking, running, waking up, or cycling. Other various scenarios that the user may encounter in daily life, as well as the scenarios described above, may also be applied to the usage scenarios.

The switch 2292 may switch between the first and second pads 2270 and 2280 by means of the controller 2291.

The signal power supply part 2240 may receive a switched signal of the switch 2292. The substrate 2250 may be electrically connected to the signal power supply part 2240, and may transmit and receive antenna signals of the first and second pads 2270 and 2280, which are selected by the switch 2292.

Figure 30:
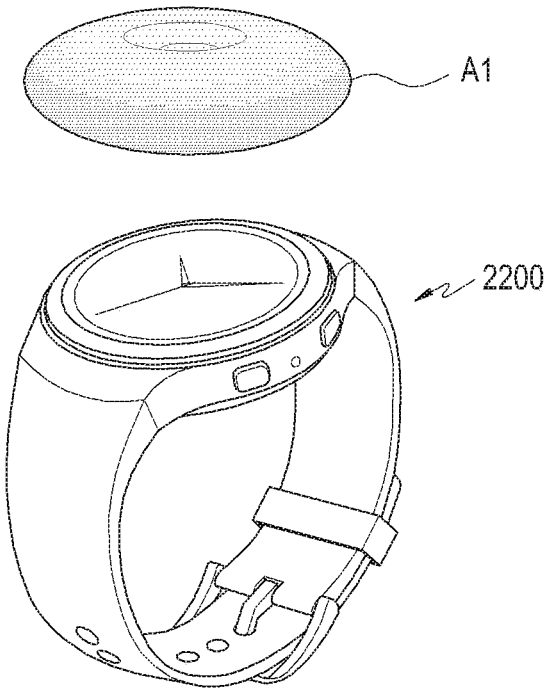
FIG. 30 is a view illustrating an antenna beam pattern that is applied during the action of walking or running according to an embodiment of the present disclosure.
Figure 31:
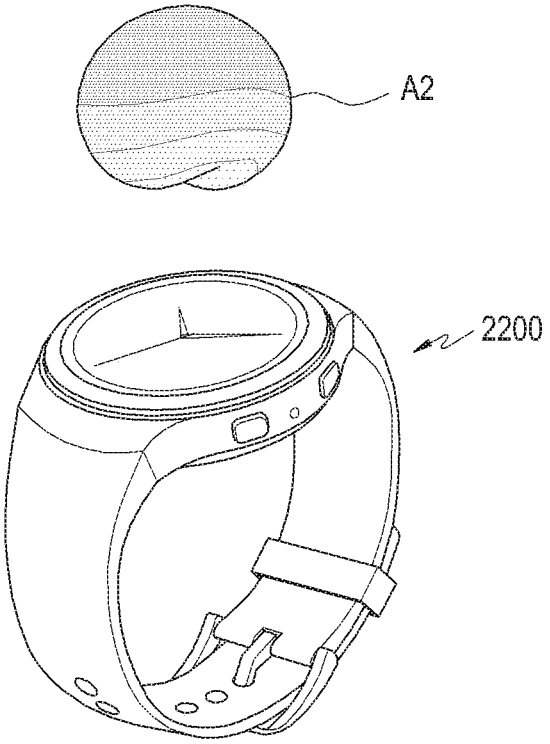
FIG. 31 is a view illustrating an antenna beam pattern that is applied during the action of waking up or cycling according to an embodiment of the present disclosure.

FIG. 30 is a view showing the state in which an antenna beam pattern of the first pad 2270 is applied in the case of walking and running among the usage scenarios according to an embodiment of the present disclosure, and FIG. 31 is a view showing the state in which an antenna beam pattern of the second pad 2280 is applied in the case of waking up and cycling among the usage scenarios according to an embodiment of the present disclosure.

Referring to FIGS. 30 and 31, the beam pattern (A1) of the first pad 2270 may be configured to include the monopole type of beam pattern, and the beam pattern (A2) of the second pad 2280 may be configured to include the patch type of beam pattern.

Referring to FIGS. 28 and 29 described above, when the user performs an action of walking or running among the usage scenarios while wearing the electronic device 2200 on the body, the sensor unit 2290 provided in the electronic device may detect such an action. For example, the sensor unit 2290 may be configured with a gyro sensor, and the gyro sensor may detect a fine motion of the electronic device 2200 according to the user's action. The sensor unit 2290 may be configured with other sensors that can detect the user's action, as well as the gyro sensor. The sensor unit 2290, for example, may measure physical quantities or may detect the operation state of the electronic device 2200 to thereby convert the measured or detected information to electric signals. The sensor unit 2290 may include at least one of, for example, a gesture sensor, a gyro-sensor, an atmospheric pressure sensor, a magnetic sensor, an acceleration sensor, a grip sensor, a proximity sensor, a color sensor (e.g., a red-green-blue (RGB) sensor), a biometric sensor, a temperature/humidity sensor, an illuminance sensor, or an ultra violet (UV) sensor. Additionally or alternatively, the sensor unit may further include an E-nose sensor, an electromyography (EMG) sensor, an electroencephalogram (EEG) sensor, an electrocardiogram (ECG) sensor, an infrared (IR) sensor, an iris sensor, and/or a fingerprint sensor. The sensor unit may further include a control circuit for controlling one or more sensors included therein. The electronic device 2200 may further include a controller as a part of the controller or separately from the same, which is configured to control the sensor unit in order to thereby control the sensor unit 2290 while the controller is in a sleep mode.

Such a sensor unit 2290 may detect a user's action, such as walking or running, and may apply the detected signal to the controller 2291. The controller 2291 may select the first pad 2270 from the first and second pads 2270 and 2280 according to the detected signal of the sensor unit 2290, and may control the switch 2292 to select the first pad 2270. The switch 2292 may switch to the first pad 2270 that is selected by the controller 2291 to then be electrically connected to the first pad 2270. The first pad 2270 may induce a one-wavelength resonance of the length (L1) of the electronic device 2200, and may form the monopole type of beam pattern (A1). The switch 2292 may transmit and receive the resonance signal of one wavelength of the first selected pad 2270 to and from the substrate 2250 through the signal power supply part 2240. Therefore, the electronic device may select the first pad in the action of walking and running among the usage scenarios of the user, and may improve the antenna function of the electronic device to a maximum according to the selection of the first pad.

In an embodiment of the present disclosure, the operation of detecting the user's action of walking or running based on the motion of the electronic device 2200 that is detected by means of the sensor unit 2290 may be implemented to be performed by the controller 2291, instead of the sensor unit 2290.

As another example, when the user performs an action of waking up or cycling among the usage scenarios, the sensor unit 2290 provided in the electronic device 2200 may detect the action of waking up or cycling. For example, the sensor unit 2290 may detect the action of waking up or cycling, and may apply the detected signal to the controller 2291. The controller 2291 may select the second pad 2280 from the first and second pads 2270 and 2280 according to the detected signal of the sensor unit 2290, and may control the switch 2292 to select the second pad 2280. The switch 2292 may switch to the second pad 2280 selected by the controller 2291 to then be electrically connected to the second pad 2280. The second pad 2280 may induce a half-wavelength resonance of the width (L2) of the electronic device, and may form the patch type of beam pattern (A2). The switch 2292 may transmit and receive the half-wavelength resonance signal of the second selected pad 2280 to and from the substrate 2250 through the signal power supply part 2240. Therefore, the electronic device may select the second pad in the action of waking up or cycling among the usage scenarios of the user, and may improve the antenna function of the electronic device to a maximum according to the selection of the second pad.

In an embodiment of the present disclosure, the operation of detecting the user's action of waking up or cycling based on the motion of the electronic device 2200 that is detected by means of the sensor unit 2290 may be implemented to be performed by the controller 2291, instead of the sensor unit 2290.

As described above, the electronic device may select the first or second pad 2270 or 2280 according to the usage scenario of the user, and may select the antenna beam pattern of the first or second pad 2270 or 2280 so that the user can easily select the antenna beam pattern depending on various usage scenarios that may occur in daily life, thereby improving the performance of the antenna.

According to various embodiments of the present disclosure, the electronic device may include a window; a touch panel; a display that includes a conductive layer; a first pad that is electrically coupled to the conductive layer in order to utilize the conductive layer as an antenna radiator, and induces a one-wavelength resonance to form a beam pattern of an antenna; a second pad that is electrically coupled to the conductive layer in order to utilize the conductive layer as an antenna radiator, and induces a half-wavelength resonance to form a beam pattern of an antenna; a sensor unit that detects motions of the electronic device; a controller that determines a usage scenario of the electronic device by using the sensor unit, and controls a switch to select the first pad or the second pad; a switch that switches between the first pad and the second pad by means of the controller; a signal power supply part that receives a switched signal of the switch; a substrate that is electrically connected to the signal power supply part, and transmits and receives an antenna signal of the first pad or the second pad that is selected by the switch; and a rear case that supports the substrate.

According to various embodiments of the present disclosure, the first pad may induce a one-wavelength resonance of the length of the electronic device to then form the monopole type of beam pattern, and the second pad may induce a half-wavelength resonance of the width of the electronic device to then form the patch type of beam pattern.

According to various embodiments of the present disclosure, the sensor unit may detect an action of walking or running among the usage scenarios, and the controller may control the switch to switch to the first pad to be electrically connected according to the detected signal and to induce a one-wavelength resonance of the first pad to form the monopole type of beam pattern. Furthermore, the sensor unit may detect an action of waking up or cycling among the usage scenarios, and the controller may control the switch to switch to the second pad to be electrically connected according to the detected signal and to induce a half-wavelength resonance of the second pad to form the patch type of beam pattern.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An electronic device comprising:

a display including a conductive layer; and a signal power supply part electrically connected to the conductive layer to utilize the conductive layer as an antenna radiator, wherein the signal power supply part is wirelessly and electrically coupled to the conductive layer.

2. An electronic device comprising:
a window;
a touch panel;
a display including a conductive layer;
a signal power supply part electrically coupled to the conductive layer to utilize the conductive layer as an antenna radiator;
a substrate electrically connected to the signal power supply part to transmit and receive a signal of the antenna radiator of the conductive layer through the signal power supply part; and
a rear case supporting the substrate.

3. The electronic device according to claim 2, wherein the display is configured to include one of a liquid crystal display (LCD) or an organic light emitting diode (OLED).

4. The electronic device according to claim 2, wherein the conductive layer is configured to include a thin film transistor (TFT) array layer.

5. The electronic device according to claim 2, wherein the signal power supply part is disposed, in a first area out of a central area of the display, in a second area on an opposite side of the first area, or in the central area of the display.

6. The electronic device according to claim 2, wherein a patch antenna is provided between the display and the signal power supply part.

7. The electronic device according to claim 2, wherein an extended ground is provided under the signal power supply part to be electrically connected to the substrate for a stable antenna operation when utilizing the conductive layer of the display as the antenna radiator.

8. The electronic device according to claim 2,
wherein a patch antenna is provided between the display and the signal power supply part, and
wherein an extended ground is provided under the signal power supply part to be electrically connected to the substrate for a stable antenna operation when utilizing the patch antenna as the antenna radiator.

9. The electronic device according to claim 2, further comprising a film provided between the touch panel and the display to be coupled to the signal power supply part in order to be utilized as the antenna radiator.

10. The electronic device according to claim 9, wherein the film is configured to include a metal mesh film.

11. The electronic device according to claim 9, wherein the film is provided with a coupling power supply part that is coupled to the signal power supply part.

12. The electronic device according to claim 2, further comprising:
a film provided between the touch panel and the display to be coupled to the signal power supply part in order to utilize the film as an antenna radiator, and
a shorting part provided under the display to implement a multi-band antenna by utilizing the conductive layer as the antenna radiator.

13. The electronic device according to claim 2, wherein the signal power supply part is directly and electrically connected to the conductive layer.

14. The electronic device according to claim 13, further comprising a patch antenna provided between the display and the signal power supply part.

15. The electronic device according to claim 13, further comprising an extended ground provided between the display and the substrate to be electrically connected to the substrate for a stable antenna operation when utilizing the conductive layer of the display as the antenna radiator.

16. The electronic device according to claim 13, further comprising:
a patch antenna provided between the display and the signal power supply part, and
an extended ground provided between the patch antenna and the substrate to be electrically connected to the substrate for a stable antenna operation when utilizing the conductive layer of the display as the antenna radiator.

17. The electronic device according to claim 13, further comprising a film provided between the touch panel and the display to be directly and electrically connected to the signal power supply part in order to be utilized as an antenna radiator.

18. The electronic device according to claim 17,
wherein the signal power supply part directly and electrically connects the film and the conductive layer of the display at the same time, and
wherein the signal power supply part comprises:
a first power supply part that is directly and electrically connected to the film,
a second power supply part that is directly and electrically connected to the conductive layer of the display, and
a third power supply part that is directly and electrically connected to the substrate.

19. An electronic device comprising:
a window;
a touch panel;
a display including a conductive layer;
a signal power supply part electrically coupled to the conductive layer for the utilization of the conductive layer as an antenna radiator and for frequency tuning of the antenna radiator;
a shorting part provided near the signal power supply part for the frequency tuning of the antenna radiator;
a substrate electrically connected to the signal power supply part and the shorting part to transmit and receive a signal of the antenna radiator of the conductive layer and a tuned signal of the shorting part through the signal power supply part and the shorting part;
a rear case supporting the substrate; and
a ground provided under the substrate to be electrically connected to the substrate.

20. The electronic device according to claim 19, wherein the signal power supply part is configured to adjust a reduction or increase in the resonant frequency by changing the shape of a power supply pad.

21. The electronic device according to claim 19, wherein the shorting part is configured to:
adjust a reduction in the resonant frequency, and
induce an additional resonance.

22. The electronic device according to claim 19, wherein the ground induces an additional resonance.

23. An electronic device comprising:
a window;
a touch panel;
a display including a conductive layer;
a signal power supply part electrically coupled to the conductive layer for the utilization of the conductive layer as an antenna radiator and for the frequency tuning of the antenna radiator;
an active element provided near the signal power supply part for the frequency tuning of the antenna radiator;
a substrate electrically connected to the signal power supply part and the active element to transmit and receive a signal of the antenna radiator of the conductive layer and a frequency tuning signal of the active element through the signal power supply part and the active element;

a rear case supporting the substrate; and a ground provided under the substrate to be electrically connected to the substrate to induce an additional resonance.

24. The electronic device according to claim 23, wherein the active element includes a varactor diode.

25. The electronic device according to claim 23, wherein the active element includes a plurality of active elements provided to be symmetrically disposed on both sides of the display or to be disposed along the outer periphery of the display.

26. An electronic device comprising:

a window;

a touch panel;

a display including a conductive layer;

a first pad electrically coupled to the conductive layer in order to utilize the conductive layer as an antenna radiator, and induces a one-wavelength resonance to form a beam pattern of an antenna;

a second pad electrically coupled to the conductive layer in order to utilize the conductive layer as the antenna radiator, and induces a half-wavelength resonance to form a beam pattern of an antenna;

a switch configured to switch between the first pad and the second pad;

a sensor configured to detect motions of the electronic device;

at least one processor configured to:

determine a usage scenario of the electronic device by using the sensor unit, and control the switch to select the first pad or the second pad;

a signal power supply part configured to receive a switched signal of the switch;

a substrate electrically connected to the signal power supply part, and configured to transmit and receive an antenna signal of the first pad or the second pad selected by the switch; and a rear case supporting the substrate.

27. The electronic device according to claim 26, wherein the first pad is configured to induce a one-wavelength resonance of the length of the electronic device to then form a monopole type of beam pattern, and wherein the second pad is configured to induce a half-wavelength resonance of the width of the electronic device to then form a patch type of beam pattern.

28. The electronic device according to claim 27, wherein, when the usage scenario corresponds to walking or running, the at least one processor is further configured to control the switch to switch to the first pad to be electrically connected and induce a one-wavelength resonance of the first pad to form the monopole type of beam pattern, and wherein, when the usage scenario corresponds to waking up or cycling, the at least one processor is further configured to control the switch to switch to the second pad to be electrically connected and induce a half-wavelength resonance of the second pad to form the patch type of beam pattern.

29. The electronic device according to claim 27, wherein the electronic device is wearable and configured to be worn on a user's body.

* * * * *